US012674289B2

(12) United States Patent
Derian et al.

(10) Patent No.: US 12,674,289 B2
(45) Date of Patent: Jul. 7, 2026

(54) SEISMIC DAMPING PIER FOUNDATION SYSTEM FOR SEISMIC ISOLATION

(71) Applicant: Cover Technologies, Inc., Gardena, CA (US)

(72) Inventors: Craig Derian, Gardena, CA (US); Alexis Xavier Rivas, Gardena, CA (US); Gregory Nielsen, Gardena, CA (US); Hamahito Hokyo, Gardena, CA (US)

(73) Assignee: Cover Technologies, Inc., Gardena, CA (US)

( * ) Notice: Subject to any disclaimer, the term of this patent is extended or adjusted under 35 U.S.C. 154(b) by 431 days.

(21) Appl. No.: 18/225,402

(22) Filed: Jul. 24, 2023

(65) Prior Publication Data

US 2024/0026617 A1 Jan. 25, 2024

Related U.S. Application Data

(60) Provisional application No. 63/397,248, filed on Aug. 11, 2022, provisional application No. 63/391,646, filed on Jul. 22, 2022.

(51) Int. Cl.

| | |
|---|---|
| ***E01D 19/02*** | (2006.01) |
| ***E02D 27/34*** | (2006.01) |
| ***E02D 27/35*** | (2006.01) |

(52) U.S. Cl.

CPC ..... *E01D 19/02* (2013.01); *E02D 27/34* (2013.01); *E02D 27/35* (2013.01)

(58) Field of Classification Search

CPC ..... E01D 19/02; E02D 27/34; E02D 27/35

See application file for complete search history.

(56) References Cited

U.S. PATENT DOCUMENTS 5,980,162 A * 11/1999 McCown ..... E02D 27/34 405/251
8,291,650 B2 * 10/2012 Vreeland ..... E04H 9/0235 52/126.5
11,002,031 B2 * 5/2021 Colenso ..... E04H 9/0235

FOREIGN PATENT DOCUMENTS

CN 106120546 A * 11/2016 ..... E01D 19/045
CN 217399383 U * 9/2022

* cited by examiner

*Primary Examiner* — Gary S Hartmann
(74) *Attorney, Agent, or Firm* — Run8 Patent Group, LLC; Peter Miller

(57) ABSTRACT

A foundation system includes: a pier supporting a bottom surface of a structure; a collar on the pier 1defining a first and second cable guide; a thrust bearing on the collar opposite the pier; a thrust plate on the bottom surface of the structure configured to mate with the thrust bearing; a first cable extending through the first cable guide along a first horizontal axis; a second cable extending through the second cable guide along a second horizontal axis; a first spring assembly coupled to the bottom surface of the structure and to the first cable configured to tension the first cable along the first horizontal axis to return the structure to a center position; and a second spring assembly coupled to the bottom surface of the structure, and configured to tension the second cable along the first horizontal axis to return the structure to the center position.

20 Claims, 11 Drawing Sheets

SEISMIC DAMPING PIER FOUNDATION SYSTEM FOR SEISMIC ISOLATION

CROSS-REFERENCE TO RELATED APPLICATIONS

This application claims the benefit of U.S. Provisional Application No. 63/391,646, filed on 22 Jul. 2022 and U.S. Provisional Application No. 63/397,248, filed on 11 Aug. 2022, both of which are incorporated in their entirety by this reference.

TECHNICAL FIELD

This invention relates generally to the field of seismic isolation and more specifically to a new and useful foundation system in the field of seismic isolation.

DESCRIPTION OF THE EMBODIMENTS

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. System

Figure 1:
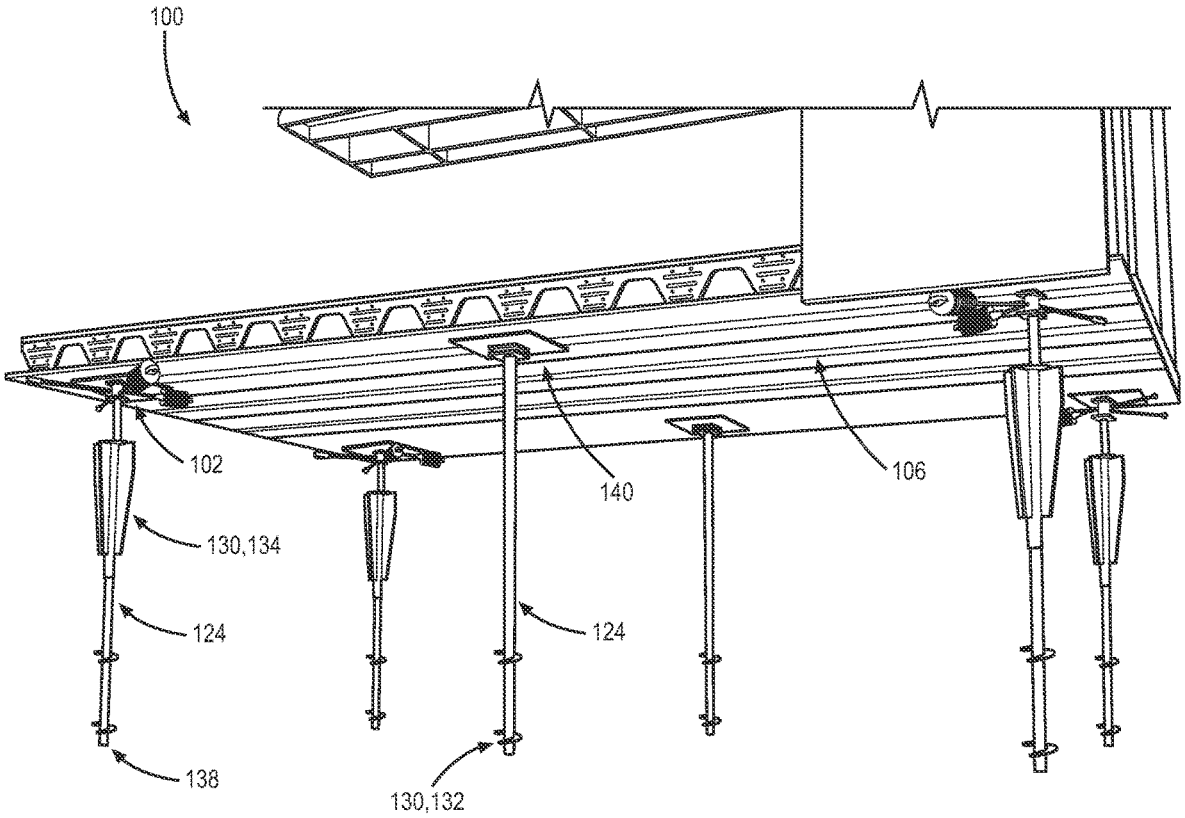
FIG. 1 is an isometric view of one variation of a foundation system.
Figure 2:
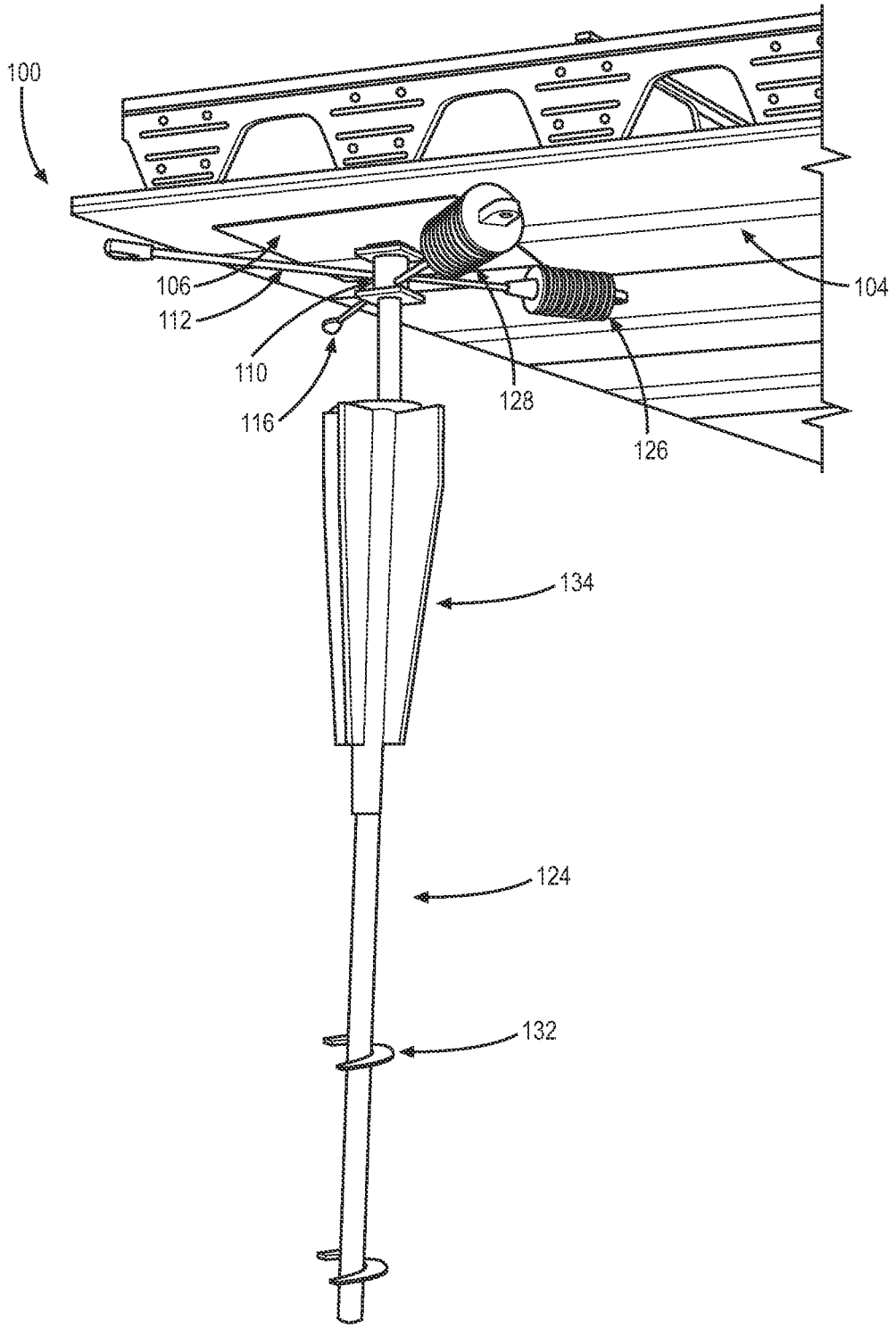
FIG. 2 is an isometric view of one variation of one variation of the foundation system.

As shown in FIGS. 1 and 2, a foundation system 100 includes: a first pier 124; a first collar 110; a thrust bearing 108; a bearing plate; a first cable; a second cable; a first spring assembly 126; and a second spring assembly 128.

The first pier 124 is configured to support a bottom surface of a structure 104 and includes: a distal end configured to install below a terrestrial frost line; and a proximal end configured to extend above the terrestrial frost line.

The first collar 110 is arranged on the proximal end of the first pier 124 and defines: a first cable guide 114 extending along a first horizontal axis 150; and a second cable guide 118 extending along a second horizontal axis 160 orthogonal to the first horizontal axis 150.

The thrust bearing 108 is arranged on the first collar 110 opposite the first pier 124.

The thrust plate 106 is arranged on the bottom surface of the structure 104 and is configured to: mate with the thrust bearing 108; and transfer a vertical load of the structure 104 onto the first pier 124 via the thrust bearing 108.

The first cable: defines a first end coupled to the bottom surface of the structure 104; is arranged extending along the first horizontal axis 150; passes through the first cable guide 14; and defines a second end opposite the first end.

The second cable: defines a third end coupled to the bottom surface of the structure 104; is arranged extending along the second horizontal axis 160; passes through the second cable guide 118; and defines a fourth end opposite the third end.

The first spring assembly 126 couples to the bottom surface of the structure 104 and the second end of the first cable 112 and is configured to: tension the first cable 112 along the first horizontal axis 150 to resist motion of the structure 104 along the second horizontal axis 160; yield to tension in the first cable 112 resulting from motion of the structure 104 along the second horizontal axis 160 from a center position; and tension the first cable 112 along the first horizontal axis 150 to return the structure 104 to the center position.

The second spring assembly 128 couples to the bottom surface of the structure 104 and to the fourth end of the second cable 116 and is configured to: tension the second cable 116 along the second horizontal axis 160 to resist motion of the structure 104 along the first horizontal axis 150; yield to tension in the second cable 116 resulting from motion of the structure 104 along the first horizontal axis 150 from a center position; and tension the second cable 116 along the first horizontal axis 150 to return the structure 104 to the center position.

In one variation, the foundation system 100 can include a second pier 124 including: a second thrust bearing 108; a second thrust plate 106; and a leveling assembly.

The second pier 124 is configured to support the bottom surface of the structure 104 and includes: a distal end configured to install below the terrestrial frost line and a proximal end configured to extend above the terrestrial frost line.

The second thrust bearing 108 is arranged on the proximal end of the second pier 124.

The second thrust plate 106 is arranged on the bottom surface of the structure 104 and configured to: mate with the second thrust bearing 108; and transfer a vertical load of the structure 104 onto the second pier 124 via the second thrust bearing 108.

The leveling assembly is arranged below the second thrust bearing 108 on the second pier 124 and includes a vertical length adjustment element operable over a range of vertical positions to locate the second thrust bearing 108 in contact with the second thrust plate 106.

2. Applications

Generally, the foundation system 100 includes a set of piers configured to support a structure 104 (e.g., a residential home) and mechanically decouple the structure 104 from the Earth. In particular, each pier 124 of the pier foundation system 100 can include: a seismic damping subsystem 102 to restore the structure 104 to a center position in response to seismic displacement; a ground stability subsystem 130 to anchor the pier 124 within the ground (e.g., below a terrestrial frost line); and/or a leveling subsystem 140 to mechanically level a bottom surface of the structure 104. The foundation system 100 can be installed on a construction site to form a complete foundation on which a structural floor can then be installed, thereby replacing a traditional slab foundation.

In particular, the foundation system 100 includes: a pier 124 configured to insert into and to carry the load of a structure 104 into ground strata; a thrust bearing 108 and thrust plate 106 configured to frictionally couple and translate relative each other via seismic and/or wind forces on the structure 104; and a set of spring assemblies and cables that couple the structure 104 to the pier 124, cooperate to resist horizonal and vertical displacement of the structure 104 (e.g., during a seismic event), and recenter the structure 104 over each pier 124.

In one implementation, the foundation system 100 is configured to retain the structure 104 at and restore the structure 104 to a center position in which the force of the structure 104 (e.g., the weight of the structure 104) is evenly distributed across a set of piers. The piers dynamically adjust (e.g., translate and/or rotate) to forces of the structure 104 to accommodate changes to the structure 104 such as construction and settling. Therefore, the foundation system 100 is configured to increase longevity of both the structure 104 and the foundation system 100 itself by dynamically reacting to and balancing forces present on the structure 104 and the foundation system 100.

For example, during a seismic event, the ground can impart horizontal forces on the structure 104. The foundation system 100 replaces traditional hard connections between the ground, the foundation, and the structure 104 with: an array of piers anchored into the ground; thrust plates along the bottom surface of the structure 104 that slide across the tops of the piers and cooperate with the piers to vertically support the structure 104; spring assemblies that apply damped restorative forces to recenter the structure 104 on the piers responsive to lateral and lift loads and that exhibit compliance between the piers and the foundation system 100 in three linear degrees of freedom and rotation in the horizontal plane. During a seismic event, the foundation system 100 enables the structure 104 to horizontally displace in response to the seismic forces, thereby displacing the structure 104 independent of the ground and reducing the amount of force the seismic event imparts on the structure 104. A seismic damping subsystem 102 of the foundation system 100 can exert restoring forces to re-center the structure 104 and slow further movement of the structure 104.

In one implementation, the foundation system 100 is configured to be "tunable" (e.g., adjustable) based on characteristics of the structure 104 and/or the location of the structure 104. For example, for a structure 104 in a geographic region with high intensity seismic events, the foundation system 100 can include a seismic damping subsystem 102 including: high compliances to allow the structure 104 to shift in response to seismic loads; and high spring and damping constants to apply a restoring force to slowly recenter the structure 104 while minimizing oscillation. In another example, for a structure 104 in a location with sloping terrain, the foundation system 100 can include a dynamic leveling subsystem 140 configured to viscoelastically respond to changes in the leveling of the structure 104, such as due to movement of the ground or piers within the ground.

Further, the foundation system 100 is configured for simple installation. For example, the foundation system 100 can include pre-assembled and pre-tuned piers such that installation of the foundation system 100 includes positioning of each pier 124 and placement of a base of the structure 104 onto the piers. Therefore, the installation of the foundation system 100 can occur over a period of days—rather than weeks or months for a traditional foundation—and without specialized labor.

The foundation system 100 is additionally configured to install with higher tolerances than traditional construction techniques. For example, the dynamic adjustability of the seismic damping subsystem 102 and the leveling subsystems enable the piers to be installed offset from a target installation position (e.g., by up to 8 inches) and maintain balanced forces about the structure 104.

Furthermore, the foundation system 100 includes redundant and easily replaceable components to simplify maintenance and thereby lengthen a lifetime of the foundation system 100. For example, the piers can include non-specific off-the-shelf components including piers, dampers, springs, thrust plates, and cables that are configured to be interchangeable throughout the foundation system 100. In another example, the foundation system 100 is configured to be easily serviceable, such as by simply removing and replacing a seismic damping subsystem 102 of a pier 124 after a seismic event.

3. Reference Frame and Center Position

Each pier 124 of the foundation system 100 described below is within a reference frame in which the ground and therefore each pier 124 is immobile.

For example, for a seismic event in this reference frame, a force of the seismic event displaces the structure 104 from a center position of the structure 104. Additionally, the overall displacement of the structure 104 results in an approximately equal (e.g., within 1%) displacement of each thrust plate 106 of each pier 124 relative to the central axis of the pier 124.

The center position defines a position of the structure 104 that the seismic damping subsystem 102 is tuned to (e.g., tensioned to) restore the structure 104 to in response to a displacement of the structure 104, such as by wind or a seismic event.

In one implementation the center position of the structure 104 can define a position at which the seismic damping subsystem 102 imparts a minimal total force (e.g., zero force or equally balanced opposing forces) on the structure 104. For example, the position that the structure 104 is installed within can define the center position. In another implementation, the center position of the structure 104 can define a position at which the seismic damping subsystem 102 imparts only a pre-load force on the structure 104. Further, when the structure 104 occupies the center position, the central axis of each pier 124 of the foundation system 100 aligns with a target coordinate on the bottom surface of the structure 104.

4. Foundation System

The foundation system 100 includes a set of piers configured to support the vertical load of the structure 104. The foundation system 100 can include a combination of piers based on parameters of the location of the structure 104. For example, for a structure 104 located on a hill and in a seismically active region, the foundation system 100 can include: a first pier 124 including a seismic damping subsystem 102; and a second pier 124 including a leveling subsystem.

4.1 First Pier

In particular, a first pier 124 can include a seismic damping subsystem 102 including: a first pier 124 (e.g., a steel bar including a distal end buried within the ground and a proximal end extending above the ground); a first collar 110 mounted proximal end of the pier 124 and defining a set of cable guides extending in orthogonal directions in a horizontal plane normal to an axis of the pier 124; and a thrust bearing 108 arranged over the top of the collar 110 and the pier 124. The seismic damping subsystem 102 also includes: a thrust plate 106 mounted to an underside of a structure 104 (e.g., a commercial or residential structure) and defining a downward-facing bearing surface configured to slide over and transfer a load (e.g., the floor structure 104) onto the top of the first pier 124; a set of (e.g., two) damper mounts 122 and opposing cable anchor 120 pairs arranged radially about the thrust plate 106 and mounted to the underside of the floor structure 104; a first spring assembly 126 including a first end pivotably-mounted to a first damper mount 122; a first cable 112 coupled to a second end of the first spring assembly 126, running through the first cable guide 114 in the collar 110 (e.g., via a loose running fit), mounted to a first cable 112 anchor, and tensioned between the first spring assembly 126 and the first cable 112 anchor; a second spring assembly 128 including a first end pivotably-mounted to a second damper mount 122; and a second cable 116 coupled to a second end of the second spring assembly 128, threaded through the second cable guide 118 in the collar 110, mounted to a second cable 116 anchor, and tensioned between the second spring assembly 128 and the second cable 116 anchor.

The set of cable anchor 120S secure the first cable 112 and the second cable 116 to the bottom of the structure 104. The set of damper mounts 122 secure the first spring assembly 126 and the second spring assembly 128 to the bottom of the structure 104. Further, the thrust plate 106 is secured (e.g., via fasteners 146) to the bottom of the structure 104.

The first pier 124, the first collar 110 arranged on the proximal end of the first pier 124, and the thrust bearing 108 are independent of (e.g., not coupled to) the structure 104. Therefore, when the structure 104 moves due to forces, such as seismic or wind forces, the first cable 112 and the second cable, the first spring assembly 126 and the second spring assembly 128, and the thrust plate 106 move relative to the first pier 124, the first collar 110, and the thrust bearing 108.

In this example, during a seismic event, because the thrust bearing 108 is mechanically coupled to the thrust plate 106, the thrust bearing 108 can move relative to the thrust plate 106 causing the first cable 112 and the second cable 116 to deflect against the cable guides of the first collar 110 due to lateral movement of the structure 104. The lateral movement of the thrust bearing 108 tensions the cables, thereby actuating (e.g., expanding or compressing) the spring assemblies. When actuated, the spring assemblies apply a restoring force on the cable guides of the collar 110. Thus, the spring assemblies are configured to reduce motion of on the structure 104 and restore the structure 104 to the center position.

In one example, the first cable 112 and the first spring assembly 126 are configured to cooperate to apply a restoring force against the first cable guide 114 along a second horizontal axis 160 to restore the structure 104 to the center position over the first pier 124 in response to motion of the structure 104 along the second horizontal axis 160. The second cable 116 and the second spring assembly 128 are configured to cooperate to apply a restoring force to the second cable guide 118 along the first horizontal axis 150 to restore the structure 104 to the center position over the first pier 124 in response to motion of the structure 104 along the first horizontal axis 150.

In another example, the first cable 112 and the second cable 116 and the first spring assembly 126 and the second spring assembly 128 can further cooperate to apply restoring forces against the first and second cable guides 118 of the first collar 110 along a direction within the horizontal plane (e.g., the plane defined by the first and second horizontal axes) to restore the structure 104 to the center position over the first pier 124 in response to motion of the structure 104 in a direction that is non-parallel to either the first or second horizontal axes.

Figure 8A:
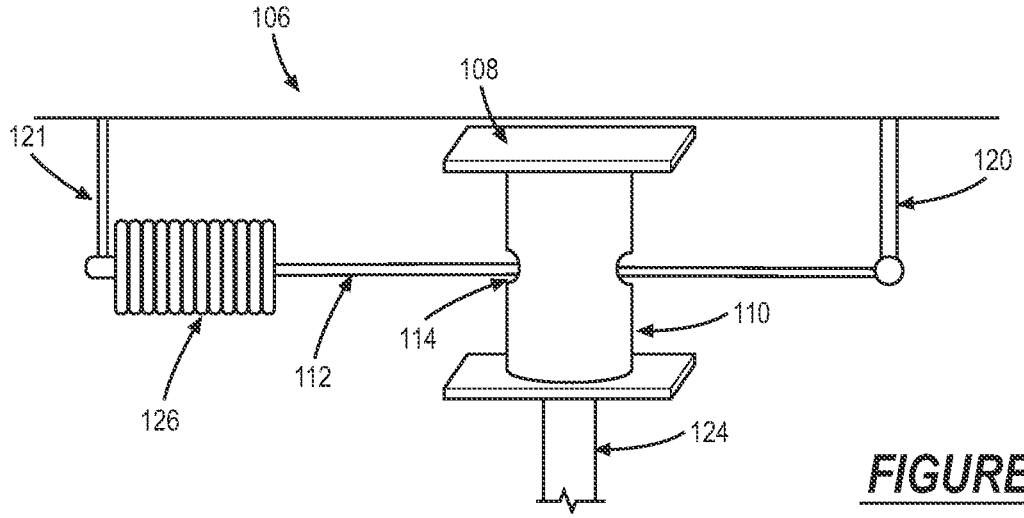
FIG. 8A is a side view of the foundation system.
Figure 8B:
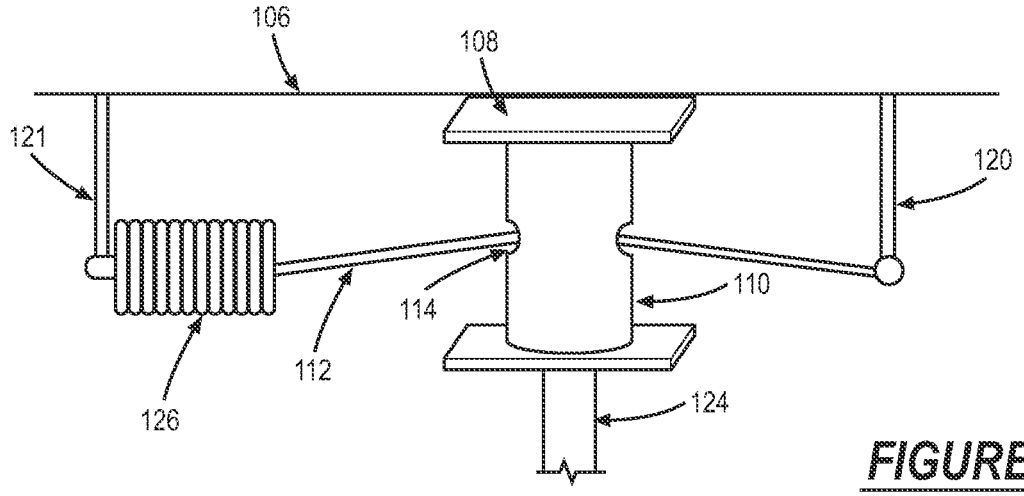
FIG. 8B is a side view of the of the foundation system.
Figure 8C:
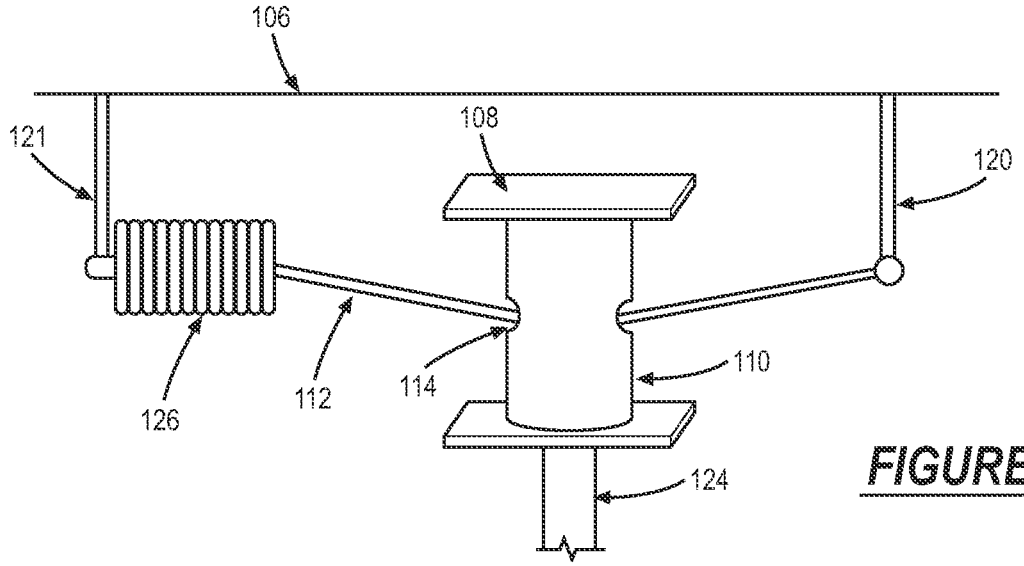
FIG. 8C is a sideview of the foundation system.

In another example, the first cable 112 and the second cable 116 cooperate to restore the structure 104 to center position in response to a lift force (e.g., a wind force) displacing the structure 104 vertically above the center position—shown in FIG. 8C. For example, the first cable 112 and the second cable 116 apply a downward (e.g., toward the distal end of the first pier 124) restoring force against the first collar 110 to restore the structure 104 to the center position.

Furthermore, the cables and the spring assemblies can be pretensioned (e.g., "tuned") to a target preload force based on specifications of the structure 104, such as proportional to a total weight of the structure 104, proportional to a height of the structure 104 or its center of mass over the pier 124, and/or a proportion to the weight of the structure 104 carried by the pier 124.

4.2 Second Pier

Figure 6:
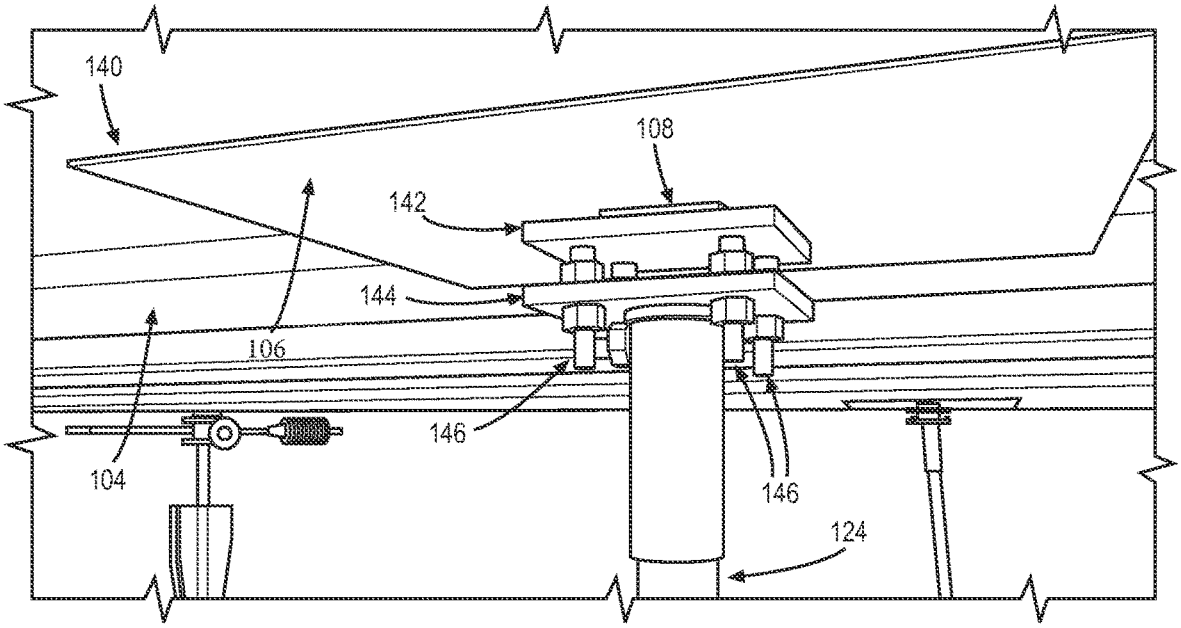
FIG. 6 is an expanded isometric view of the foundation system.

In one implementation, the foundation system 100 can include a second pier 124 including a leveling subsystem 140 configured to set a level of the structure 104—shown in FIG. 6.

Generally, the leveling subsystem 140 can include a second pier 124; a thrust bearing 108, a thrust plate 106; a vertical length adjustment element operable over a range of vertical positions configured to locate the second thrust bearing 108 in contact with the second thrust plate 106; and a pivot configured to accommodate an offset angle between an axis of the second pier 124 and a vector normal to the second thrust plate 106.

Similarly to the first pier 124, the second pier 124 (e.g., a steel bar) includes: a distal end installed within the ground (e.g., below a terrestrial frost line); and a proximal end extending above the ground. The thrust bearing 108 couples to the proximal end of the second pier 124. The thrust plate 106: couples to the bottom surface of the structure 104; mates with the thrust bearing 108; and transfers a vertical load of the structure 104 onto the second pier 124 via the thrust bearing 108. The thrust bearing 108 is configured to translate relative to the thrust plate 106 by sliding against the surface of the thrust plate 106. In one variation, the thrust plate 106 and/or the thrust bearing 108 can include a polymer coating configured to decrease a coefficient of friction between the thrust plate 106 and the thrust bearing 108 to enable translation of the thrust bearing 108. Therefore, the thrust bearing 108 displaces from a center position relative to the thrust bearing 108 in response to a seismic force that displaces the structure 104.

Generally, the leveling system includes a vertical length adjustment element and a pivot. The vertical length adjustment element is configured to extend to multiple vertical positions to enable the thrust bearing 108 to contact the thrust plate 106. For example, the vertical length adjustment element can include a rotatable portion of the pier 124 configured to: lengthen the pier 124 in response to rotation in a first direction; and retract the pier 124 in response to rotation in a second direction opposite the first direction. The pivot is configured to enable the thrust bearing 108 to pitch and roll, therefore accommodating an offset angle between an axis of the pier 124 and a vector normal to the thrust plate 106. For example, the pivot can include a ball and socket joint coupling the thrust bearing 108 to the top of the collar 110.

In one variation, the leveling subsystem 140 includes two stabilization plates coupled by a set of fasteners 146. The fasteners 146 are located between two stabilization plates to adjust a vertical space between the plates (e.g., vertical length adjustment element). Each fastener is configured to adjust a space between the stabilization plates independently of the other fasteners 146 thereby pivoting a first stabilization plate 142 relative to a second stabilization plate 144 (e.g., the pivot)

In this variation, the second pier 124 additional includes a first and second stabilization plate 144 (e.g., metal sheets) coupled by a set of fasteners 146 arranged below the thrust bearing 108 on the pier 124. The first and second stabilization plate 144 each define a set of holes; the first stabilization plate 142 defining a first set of holes that align with a second set of holes defined by the second stabilization plate 144. For example, each stabilization plate can define a rectangular geometry and include a hole at each corner. The set of fasteners 146 threadedly couples the first stabilization plate 142 to the second stabilization plate 144. Each fastener of the set of fasteners 146 is configured to rotate to set a distance between the first stabilization plate 142 and the second stabilization plate 144 at an aligned hole of the first stabilization plate 142 and the second stabilization plate 144. Each fastener of the set of fasteners 146 is configured to set the distance between the first stabilization plate 142 and the second stabilization plate 144 to define a level (e.g., a pitch and roll) of the first stabilization plate 142 relative to the second stabilization plate 144. Therefore, each pier 124 including the leveling assembly sets a level of the structure 104.

Figure 5:
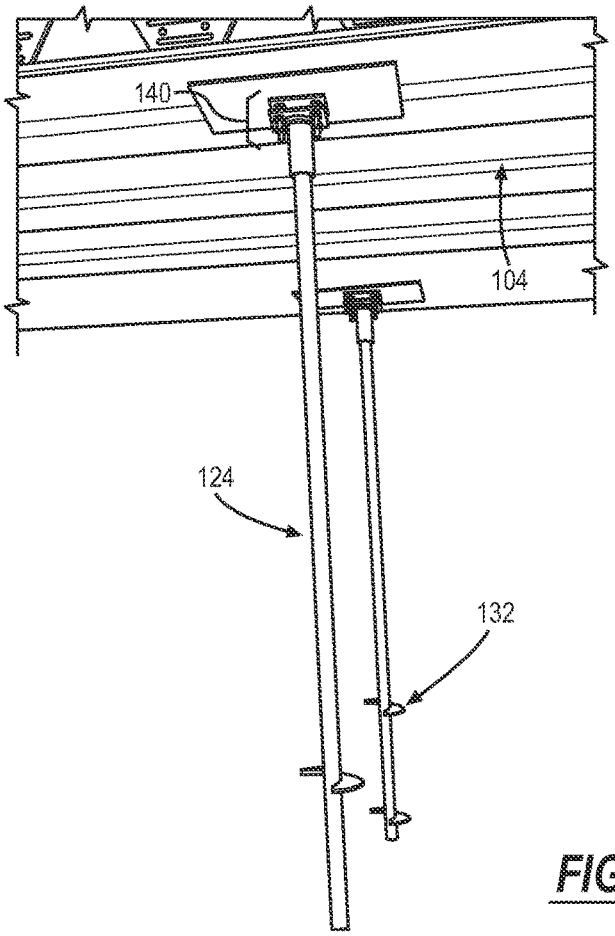
FIG. 5 is an isometric view of one variation of the foundation system.

In one implementation, the leveling subsystem 140 includes a first rectangular stabilization plate mechanically coupled to the second face of the thrust bearing 108. In one variation, the first stabilization plate 142 can include a first set of holes positioned at each corner of the first stabilization plate 142 extending through the first stabilization plate. As shown in FIGS. 5, and 6, the leveling subsystem 140 further includes a second stabilization plate 144 positioned at a distance below the first stabilization plate. In one variation, the second stabilization plate 144 includes a second set of holes positioned at each corner of the second stabilization plate 144 extending through the second stabilization plate 144. More specifically, the first set of holes of the first stabilization plate 142 is vertically aligned with the second set of holes of the second stabilization plate 144. Thus, the first stabilization plate 142 can be secured to the second stabilization plate 144 with a set of nuts and fasteners 146 via the first and second set of holes.

In one implementation, the set of fasteners 146 can include spring/damper assemblies to enable the first stabilization plate 142 to actuate (e.g., pitch and/or roll) relative the second stabilization plate 144 in response to an imbalance of the structure 104 that changes the level of the structure 104. Thus, the set of stabilization plates can behave as a dynamic viscoelastic damping system.

4.3 Pier Variations

Generally, the foundation system 100 includes multiple piers to support the vertical load of the structure 104. Each pier 124 can include subsystems to improve a support of the structure 104 (e.g., by leveling the structure 104 or damping seismic forces on the structure 104).

In one implementation, each pier 124 can include multiple subsystems. For example, a pier 124 can include the seismic damping subsystem 102 and a ground stability subsystem 130—shown in FIG. 2.

In one implementation, other piers can include a ground stability subsystem 130 configured to stabilize the pier 124—shown in FIG. 5. For example, a ground stability subsystem 130 can anchor the pier 124 to the ground to secure the structure 104 when the structure 104 is subject to vertical forces (e.g., winds, hurricanes). The ground stability subsystem 130 can include: a vertical collar 110; and helical bearing plates 132.

Generally, the ground stability subsystem 130 can support both upward and downward vertical loads between the structure 104 and the ground. More specifically, the ground stability subsystem 130 can support the structure 104 vertically above grade and retain the structure 104 on the ground during high winds. In one implementation, the ground stability subsystem 130 can include a pier 124 engaged with the seismic damping subsystem 102 and a set of helical extrusions extending from a shaft of the pier 124. Therefore, the ground stability subsystem 130 can vertically anchor the structure 104 to the ground to hold the structure 104 down to the foundation when the structure 104 is subject to vertical forces (e.g., winds, hurricanes).

In one implementation, a ground stability subsystem 130 includes a thrust plate 106 including a first surface (e.g., a top) and a bearing surface (e.g., a bottom) opposite the first surface. The thrust plate 106 can define a rectangular geometry, similar to that of the thrust plate 106 described above. In one variation, the first surface is mechanically coupled to the base of the structure 104 and held in place via vertical (e.g., downward) forces exerted by the structure 104 on to the base.

In one implementation, the ground stability subsystem 130 includes a set of helical extrusions extending from a shaft of the pier 124. In one variation, the helical extrusions are constructed of steel. More specifically, the steel helical extrusions can be welded to the pier 124 shaft in a helical or screw configuration based on intended ground conditions.

Additionally, or alternatively, the ground stability subsystem 130 can include a pier 124 toe 138 positioned at a second end of the pier 124 opposite the first end. Prior to construction of the structure 104 on the base, the pier 124 can be driven into the ground beginning at the pier 124 toe 138 until a threshold length of the pier 124 shaft is exposed.

In one variation, the pier foundation system 100 and the ground stability subsystem 130 are driven into the ground such that a shaft length of the pier 124 exposed above the ground is approximately equal (e.g., within 3-5 cm) to the shaft length above the vertical stabilizer 134 of the pier foundation system 100. Once the pier 124 is driven into the ground, the set of stabilization plates, can be installed atop the pier 124 shaft. The thrust bearing 108 can then be installed atop the first stabilization plate. The thrust bearing 108 can then be installed atop the collar 110, after which the base (e.g., floor layer) of the structure 104 can be placed atop the first stabilization plate 142 with the thrust plate 106 coupled to the thrust bearing 108.

A pier 124 of the pier foundation system 100 can further include a set of helical extrusions coupled to a pier 124 to vertically reinforce the structure 104 and the seismic damping subsystem 102 and to reduce vertical loads on the structure 104 due to high-speed winds. In one implementation, the system can further include a vertical stabilizer 134 coupled to the shaft of the pier 124 to further stabilize the pier foundation system 100.

As described above and shown in FIGS. 2A, and 2B, a portion of a shaft of the pier 124 can extend through the seismic damping subsystem 102 to stabilize the seismic damping subsystem 102 after the pier 124 is driven into the ground. In one variation, the pier 124 can further include a pier 124 toe 138 positioned at a second end of the pier 124 opposite the first end. Thus, during installation of the pier foundation system 100, the pier 124 is driven into the ground beginning at the pier 124 toe 138. In one implementation, the collar 110 is installed (e.g., slid over the top of the pier 124 shaft) after the pier 124 is driven into the ground. The thrust bearing 108 can then be installed atop the collar 110, after which the base of the structure 104 can be placed atop the collar 110 with the thrust plate 106 coupled to the thrust bearing 108. Once the base (e.g., floor layer) is installed, the set of cables and spring assemblies can be installed and secured in place (e.g., anchored).

In one implementation, the pier 124 can include a set of helical extrusions (e.g., two, three, five, etc.) extending horizontally from the shaft of the pier 124. In one variation, the set of helical extrusions are constructed of steel and can be welded to the pier 124 shaft in a helical or screw configuration. In one variation, the set of helical extrusions are separated from each other at a set distance (e.g., 25-30 cm). Additionally, or alternatively, to further stabilize the pier 124, each helical extrusion of the set of helical extrusions can have different dimensions relative to the other helical extrusions. For example, the diameter of each helical extrusion can decrease with each helical extrusion descending down the shaft (e.g., 400 mm, 350 mm, 300 mm, etc.). In one variation, each helical extrusion of the set of helical extrusions can have similar dimensions (e.g., all 400 mm in diameter, etc.).

In one implementation, the pier foundation system 100 can further include a vertical stabilizer 134 coupled to the shaft of the pier 124 to provide additional reinforcement and stability of the pier 124 and thus the seismic damping subsystem 102. In one variation, the vertical stabilizer 134 is positioned between the seismic damping subsystem 102 and the set of helical extrusions. In another variation the vertical stabilizer 134 is arranged below and abutting the collar 110 of the seismic damping subsystem 102.

In one variation and as shown in FIG. 1, the vertical stabilizer 134 can include a collar 110 to wrap around a portion of the shaft of the pier 124 above the set of helical extrusions. The vertical stabilizer 134 can further include a set (e.g., four) of vertical veins traversing down the length of the collar 110 characteristic of a first width. More specifically, the set of vertical veins can have a first width (e.g., 400 mm) for a first length and taper to a second width (e.g., 250 mm) smaller than the first width for a second length down to the end of the collar 110. As shown in FIG. 1, in one variation, the set of vertical veins can traverse down the collar 110 and stop at a distance away from a bottom end of the collar 110. In one variation, each vertical vein in the set of vertical veins can extend extending horizontally out from the collar 110. More specifically, each vertical vein in the set of vertical veins can be positioned at an angle (e.g., 90 degrees) relative to the adjacent vein. For example, a vertical stabilizer 134 can include a set of four veins extending from the collar 110. Thus, each vein can be angled 90 degrees relative to each adjacent vein, and therefore perpendicular to each adjacent vein in the set of vertical veins.

In one implementation, the vertical stabilizer 134 can further include an end plate positioned at the top of the vertical stabilizer 134 and coupled to the collar 110 and the set of vertical veins. Thus, during installation of the pier foundation system 100 into the ground, the pier foundation system 100 is buried in the ground from the pier 124 toe 138 to the end plate.

The piers described herein are configured for installation and construction of a residential structure 104 (e.g., a single-family home, a residential accessory dwelling unit). However, the foundation system 100 can additionally or alternatively be implemented as a foundation for construction of multi-story industrial, or commercial structure 104.

5. Seismic Damping Subsystem

As described above and shown in FIG. 3, the seismic damping subsystem 102 includes: a thrust plate 106; a thrust bearing 108; a collar 110; a set of cables; and a set of spring assemblies. The seismic damping subsystem 102 is configured to: couple to a pier 124 of the foundation system 100 (e.g., thread or slot onto a proximal end of the pier 124); and, in response to displacement of the structure 104 (e.g., by wind or seismic activity) apply a restoring force to restore the structure 104 to a center position.

The foundation system 100 can include several piers including the seismic damping subsystem 102 to divide the total seismic force across several spring assemblies. Each seismic damping subsystem 102 includes two or more spring assemblies. For a seismic damping subsystem 102 with two spring assemblies, a first spring assembly 126 is offset by 90° degrees from a second spring assembly 128 to define two orthogonal axes in which the seismic damping subsystem 102 can independently apply restoring forces.

In one variation the seismic damping subsystem 102 can include three spring assemblies offset by 60° from each other or fourth spring assemblies offset by 45° from each other. By having multiple spring assemblies at each seismic damping subsystem 102 and multiple seismic damping subsystem 102S, the foundation system 100 can divide seismic and/or wind forces on the structure 104 into multiple smaller components. Each spring assembly can thereby exert a restoring force that is a fraction of the overall restoring force of the total foundation system 100. Therefore, each spring assembly can include a set of small, low-force spring and/or damper that are more easily a) maintained or replaced, b) accessible (e.g., off the shelf), and c) installed than large and/or custom, high-force spring dampers. Furthermore, by including redundant spring assemblies, the seismic damping subsystem 102 is resilient to failure.

5.1 Thrust Plate

Generally, the thrust plate 106: immovably couples to the bottom surface of the structure 104; and defines a surface for the thrust bearing 108 atop a pier 124 to contact. Therefore, displacement of the structure 104 causes displacement of the thrust plate 106 relative to the pier 124. Generally, the thrust plate 106 is configured to: mate with a thrust bearing 108 arranged on a proximal end of the pier 124 (e.g., on top of the pier 124); and transfer a vertical load of the structure 104 (e.g., the weight of the structure 104) onto the pier 124 via the thrust bearing 108.

In one implementation, the thrust plate 106 is configured to slide in a horizontal plane over the thrust bearing 108 and to carry a load (i.e., a weight of the structure 104 structure 104) into the thrust bearing 108. The thrust plate 106 can define: a first surface coupled to the bottom surface of the structure 104; and a second surface (e.g., a bearing surface) opposite the first surface including a polymer layer configured to reduce a coefficient of friction of the second, and configured to mate (e.g., rest against, contact, fit about or with) with the thrust bearing 108.

As shown in FIGS. 3A, and 3B, the seismic damping subsystem 102 includes a thrust plate 106 coupled to the base of the structure 104. In one implementation, the thrust plate 106 is a flat rectangular plate including a first surface (e.g., a top) and a bearing surface (e.g., a bottom) opposite the first surface. In one variation, the first surface is mechanically coupled to the base of the structure 104 and held in place via vertical (e.g., downward) forces exerted by the structure 104 onto the base. More specifically, the thrust plate 106 can be mounted to an underside of the base (e.g., a floor) of the structure 104 and define a downward-facing bearing surface configured to slide over and transfer a load (e.g., the floor structure 104) onto the top of the pier 124. In one implementation, the thrust plate 106 can be constructed of a steel sheet 5-8 cm thick.

In one variation, the thrust plate 106 defines a flat bearing surface configured to mate with a round or flat thrust bearing 108. For example, a flat being surface is configured to rest against and translate relative to a round or flat thrust bearing 108. In this example the thrust bearing 108 defines a second planar surface configured to slide past the first planar surface of the thrust plate 106.

In another variation, the thrust plate 106 defines a rounded bearing surface. For example, the thrust plate 106 can define a convex semi-spherical bearing surface configured to mate with a flat or round concave thrust bearing 108. In another example, the thrust plate 106 defines a downward-facing concave bearing surface configured to mate with a convex semi-spherical thrust bearing 108. In this example, the semi-spherical thrust bearing 108: mates with the downward-facing concave surface of the thrust plate 106; translates laterally within the downward-facing concave surface of the thrust plate 106; and lifts the second thrust plate 106 on the first pier 124 to increase tension on the first cable 112 and the second cable 116 in response to displacement of the structure 104 along the first horizontal axis 150.

5.2 Thrust Bearing

Figure 3:
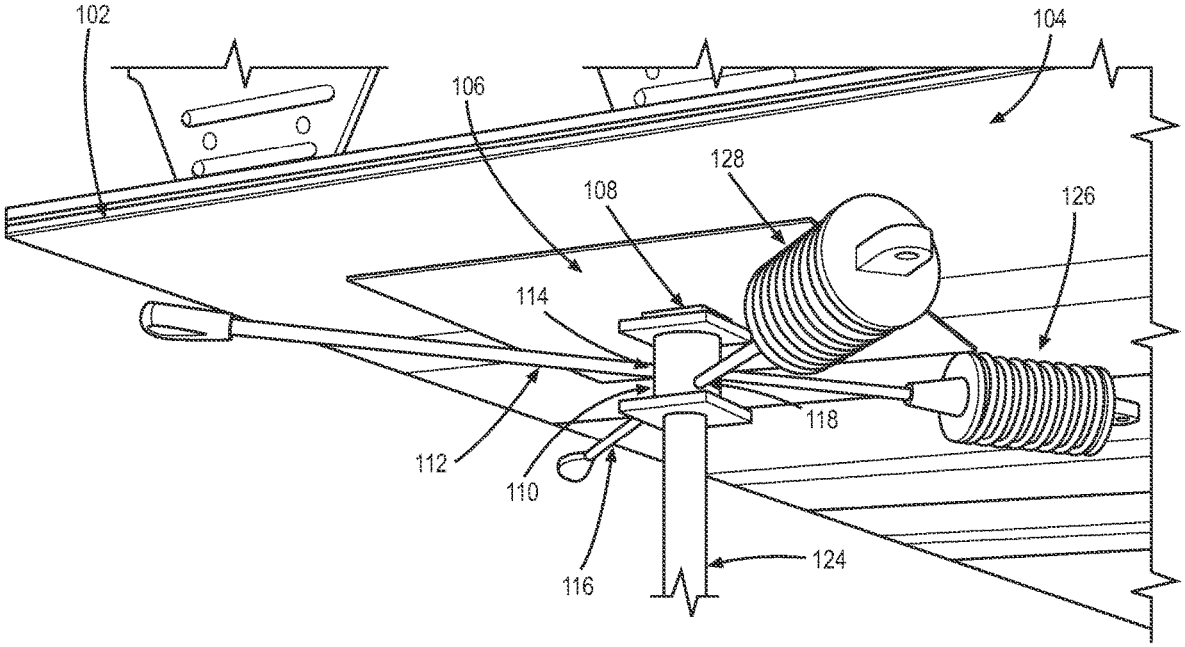
FIG. 3 is an isometric view of one variation of the foundation system.

As shown in FIG. 3, the seismic damping subsystem 102 includes a thrust bearing 108: arranged on a surface of the first collar 110 opposite the pier 124; and coupled to (e.g., moveably coupled, mated with, resting again) the thrust plate 106. In one implementation, the thrust bearing 108 is a flat rectangular component including a first face (e.g., a top) and a second face (e.g., a bottom) opposite the first face. In one variation, the first face is coupled to the bearing surface of the thrust plate 106. More specifically, the thrust bearing 108 is frictionally coupled to the thrust plate 106 via vertical (e.g., downward) forces exerted by the structure 104 onto the base. However, during a seismic event, the thrust bearing 108 can move relative to the bearing surface of the thrust plate 106 to dissipate mechanical energy via the seismic damping subsystem 102. In one variation, the thrust bearing 108 can be constructed of a viscoelastic material—such as a polymer and/or rubber material.

As described above with reference to the thrust plate 106, the thrust bearing 108 can define a flat or rounded first surface configured to mate with a flat or rounded bearing surface of the thrust plate 106.

5.3 Collar

As shown in FIG. 3, the seismic damping subsystem 102 can further include a collar 110 coupled to the thrust bearing 108. The first collar 110 defines a cylindrical geometry including: a top surface facing the bottom surface of the structure 104 configured to couple to the thrust bearing 108; and a bottom surface opposite the top surface configured to receive (e.g., define a coupling location for) the pier 124. The first collar 110: arranges on the proximal end of the pier 124; defines a first cable guide 114 extending along a first horizontal axis 150; and defines a second cable guide 118 extending along a second horizontal axis 160 orthogonal to the first horizontal axis 150.

In one implementation, the top surface of the collar 110 defines a first end plate that is coupled to the second face of the thrust bearing 108. More specifically, the first end plate is positioned at a first end (e.g., a top end) of the cylindrical base. In one variation, the cylindrical base includes an opening positioned at a second end of the cylindrical base opposite the first end extending through the cylindrical base. The opening can accept a portion of a pier 124 shaft to stabilize the seismic damping subsystem 102 on the pier 124. The collar 110 further includes a second end plate positioned at the second end of the cylindrical base that traverses the opening of the cylindrical base.

In one implementation, the collar 110 is mounted proximal atop of the pier 124 and defines a set of cable guides (e.g., through-holes) extending through the cylindrical base in orthogonal directions in a horizontal plane normal to an axis of the pier 124. More specifically, the collar 110 includes a first set of cable guides, extending through a wall of the cylindrical base. In one variation, a first cable guide 114 of the first set of holes is horizontally aligned with a second cable guide 118 of the first set of holes. The collar 110 further includes a second set of cable guides extending through the wall of the cylindrical base positioned at a distance below the first set of cable guides. Similarly, a first cable guide 114 in the second set of cable guides is horizontally aligned with a second cable guide 118 in the second set of cable guides. In one variation, the first set of cable guides is oriented at an angle to the second set of cable guides. Thus, the first set of cable guides can accept a first cable 112 while the second set of cable guides can accept a second cable 116 that is angled relative to the first cable.

Additionally, or alternatively, the collar 110 can include a set of curved (e.g., U-shaped) ribs positioned inside the cylindrical base to further stabilize the cables, extending through the first and second set of cable guides respectively. More specifically, the curved ribs can be oriented such that the concave portion of the ribs faces the wall of the cylindrical base so that the cables, are secured in place by the center of the curve. In one variation, the curbed ribs can be constructed of steel and welded to the interior surface of the cylindrical base.

In one implementation, each cable guide defines an hourglass surface including: a minor diameter (e.g., corresponding to or minimally larger than the cable diameter) at the center of the cable guide; a major diameter greater than the minor diameter proximal the surface of the cylindrical base of the collar 110; and a taper section extending between the minor diameter and the major diameter, and defining a taper angle corresponding to a maximum deflection angle of the cable. In this implementation, the cable running through the cable guide is configured to bend off axis (e.g., the first cable 112 bends off the first horizontal axis 150) and ride along the minor diameter of the hourglass surface.

In one implementation, a cable guide of the set of cable guides can include a polymer insert. The polymer insert is configured to provide a low-friction surface against which the cable can slide with minimal frictional resistance. In this implementation, in response to displacement of the structure 104 parallel to the first horizontal axis 150 during a seismic event: the first cable 112 slides through the first polymer insert of the first cable guide 114 and occupies a linear arrangement; the first collar 110 imparts a first bending force on the first cable 112 parallel to the second horizontal axis 160, and imparts a second bending force on the second cable 116 parallel to the first horizontal axis 150, the second bending force greater than the first bending force. Further, the second cable 116 deflects from the second horizontal axis 160, proportional to the second bending force, to displace the second spring assembly 128; the second spring assembly 128 tensions the second cable 116 along the second horizontal axis 160; and the second cable 116 imparts a restoring force to the collar 110 parallel to the first horizonal axis.

In the implementation described above, the first bending force imparted by the first collar 110 on the first cable 112 is a minimal frictional force from the first cable 112 sliding across the polymer insert of the first cable guide 114. Due to the displacement of the structure 104 along the first horizontal axis 150, the set of spring assemblies and the set of cables translate along the first horizontal axis 150 relative to the central axis of the pier 124 and the collar 110. However, in this example, the structure 104 does not experience displacement in axes non-parallel to the first horizontal axis 150. Therefore, the collar 110 does not bend the first cable 112 and impart a significant bending force on the first cable. However, because the structure 104 displaces in the direction of the first horizontal axis 150, the collar 110 imparts a second bending force on the second cable. The second bending force is significantly greater than (e.g., 10-200×) the first bending force, and the collar 110 bends the second cable 116 off the second horizontal axis 160.

5.4 Cables

Generally, the seismic damping subsystem 102 includes a set of cables configured to: extend through the cable guides; and be tensioned by the set of spring assemblies. In one implementation, the seismic damping subsystem 102 includes: a first cable 112 defining a first end coupled to the bottom surface of the structure 104, arranged extending along the first horizonal axis, passing through the first cable guide 114, and defining a second end opposite the first end couples to the first spring assembly 126; a second cable 116 defining a third end coupled to the bottom surface of the structure 104; arranged extending along the second horizonal axis; passing through the second cable guide 118; and defining a fourth end opposite the third end coupled to the second spring assembly 128.

In one implementation, each cable defines a braided steel cable configured to, in response to a maximum bending force, bend to a maximum deflection angle off of the axis of the cable (e.g., the first cable 112 deflects off of the first horizontal axis 150).

In one implementation, the seismic damping subsystem 102 can further include a second cable 116 for attachment of a second spring assembly 128. In one implementation, the second cable 116 extends through the second cable guides 118 of the cylindrical base of the collar 110. The second cable 116 can include a second spring assembly 128 positioned at a second end of the second cable. In one variation, the second spring assembly 128 can include a second cable 116 mount coupled to a second end plate of the second spring assembly 128. More specifically, the second cable 116 mount can include a second through-hole to secure the first end of the second cable 116 to the base of the structure 104 via a fastener Thus, the second spring assembly 128 can include a first end pivotably mounted to the second damper mount 122. The second cable 116 can further include a cable anchor 120 positioned at a second end opposite the first end. The second cable 116 anchor can include a second through-hole to secure the second end of the second cable 116 to the base of the structure 104 via a fastener. Thus, the second cable 116 can be coupled to a second end of the second spring assembly 128, running through the second set of cable guides, in the collar 110 (e.g., via a loose running fit), mounted to the second cable 116 anchor, and tensioned between the second spring assembly 128 and the second cable 116 anchor.

In one implementation, the first cable, and second cable 116 of the seismic damping subsystem 102 are oriented at an angle relative to each other. In one variation, the first cable 112 is oriented perpendicular to the second cable.

5.5 Spring Assemblies

As described above and shown in FIG. 3, the seismic damping subsystem 102 further includes a set of spring assemblies.

In one implementation, the seismic damping subsystem 102 includes a first spring assembly 126: coupled to the bottom surface of the structure 104 and to the second end of the first cable; configured to tension the first cable 112 on the first horizontal axis 150 to resist motion of the structure 104 along the second horizontal axis 160; configured to yield to tension in the first cable 112 resulting from motion of the structure 104 along the second horizontal axis 160 from a center position; and configured to tension the first cable 112 along the first horizontal axis 150 to return the structure 104 to the center position. The seismic damping subsystem 102 can further include a second spring assembly 128: coupled to the bottom surface of the structure 104 and to the fourth end of the second cable; configured to tension the second cable 116 along the second horizontal axis 160 to resist motion of the structure 104 along the first horizontal axis 150; configured to yield to tension in the second cable 116 resulting from motion of the structure 104 along first horizontal axis 150 from a center position; and configured to tension the second cable 116 along the first horizontal axis 150 to return the structure 104 to the center position.

Generally, the seismic damping subsystem 102 can include a set of (e.g., two) damper mounts 122, and opposing cable anchor 120 pairs, arranged radially about the thrust plate 106, and mounted to the underside of the floor structure 104. In one implementation, the first cable 112 can include a first spring assembly 126 positioned at a first end. In one variation, the first spring assembly 126 can include a first damper mount 122 coupled to a first end plate of the first spring assembly 126. More specifically, the first damper mount 122 can include a first through-hole to secure the first end of the first cable 112 to the base of the structure 104 via a fastener. Thus, the first spring assembly 126 can include a first end pivotably mounted to the first damper mount 122. The first cable 112 can further include a cable anchor 120 positioned at a second end including a second through-hole to secure the second end of the first cable 112 to the base of the structure 104 via a fastener. Thus, the first cable 112 can be coupled to a second end of the first spring assembly 126, extending through the first set of cable guides, in the collar 110 (e.g., via a loose running fit), mounted to a first cable 112 anchor, and tensioned between the first spring assembly 126 and the first cable 112 anchor.

In one implementation, each spring assembly includes a spring: characterized by a spring constant; and configured to apply a restoring force in response to deflection of the cable coupled to the spring assembly. In one variation, the spring is configured to expand responsive to an increase of the effective length of the cable (e.g., by deflection of the cable off the axis of the cable). In another variation, the spring is configured to compress responsive to an increase of the effective length of the cable. In both configurations, the spring applies a restoring force with a magnitude proportional to the spring constant of the spring.

In one implementation, each spring assembly includes a damper to reduce movement of the structure 104 in response to displacement of the structure 104. For example, in response to displacement of the structure 104, the damper resists further displacement by increasing a damping force in the direction of displacement. Therefore the damper slows and reduces the movement of the structure 104.

In one implementation, the spring assembly includes a spring and a damper. In response to displacement of the structure 104 (e.g., displacement of a thrust plate 106 relative to a pier 124), the spring applies a restoring force in a direction opposing the direction of displacement, and the damper resists motion of the structure 104, thereby reducing oscillation that may be caused by the spring.

In one implementation the spring assembly includes a first variable-pitch spring exhibiting a first non-linear spring constant configured to increase a spring rate of the spring assembly in response to increased displacement of the structure 104. For example, the variable-pitch spring can define a higher spring constant at higher extension, thereby allowing slight movement of the structure 104 away from the center position but applying exponentially increasing restorative force on the structure 104 at increasing displacements of the structure 104 from this center position.

5.6 Damping Mechanics

Generally, the set of spring assemblies and cables: movably couple the structure 104 to the pier 124; cooperate via the seismic damping subsystem 102 to react to horizonal and vertical displacement and of the structure 104 relative to the pier 124; and cooperate to restore the structure 104 to the center position during a seismic event.

In one implementation, when the structure 104 occupies the center position, the first spring assembly 126 and the first cable 112 are aligned along the first horizontal axis 150 and the second spring assembly 128 and the second cable 116 are aligned along the second horizontal axis 160. In this configuration, the collar 110 is arranged at the intersection of the first and second horizontal axes and the first cable 112 and the second cable 116 do not exert force on the collar 110—shown in FIG. 7A.

In particular, during a seismic event (or heavy wind loads) in which the structure 104 moves relative to the pier 124 in a direction parallel to a first horizontal axis 150 (i.e., parallel to the first cable): the thrust plate 106 slides over the thrust bearing 108; the first cable 112 slides through the first cable guide 14; the effective length of the first spring assembly 126 and the first cable 112 remains constant; and the tension on the first spring assembly 126 and the first cable 112 therefore also remain constant. However, under such motion of the structure 104 along the first axis, the effective length of the second cable 116 increases proportional to amplitude of movement of the structure 104 on the pier 124, by: expanding the spring assembly; increasing tension on the second cable; and bending the second cable 116 around the second cable guide 118. Because the second cable 116 runs through the second cable guide 118, the second cable 116 applies a restoring force against the second cable guide 118 in a direction parallel to the first horizontal axis 150 and opposite the displacement of the structure 104, which restores the structure 104 to the center position.

More specifically, the set of cables are tensioned against the set of spring assemblies and are configured to slide (or "run") within the cable guides. In particular, when the structure 104 moves (e.g., horizontally) relative to the seismic lift system in a direction parallel to a first horizontal axis 150 extending between the first spring mount and first cable 112 anchors (i.e., parallel to the first cable) during a seismic event, the thrust plate 106 can slide over the thrust bearing 108, the first cable 112 can slide through the first set of cable guides. Thus, the length of the first spring assembly 126 and the first cable 112 can remain constant, and the tension on the first spring assembly 126 and the first cable 112 can therefore also remain constant. However, during such motion along the first axis, the effective distances between the second set of cable guides, and the second spring mount and between the second cable guides 118, and the second cable 116 anchor increases proportional to amplitude of movement of the structure 104 on the pier 124. Therefore, during the vibration (seismic event), the second spring assembly 128 expands, thereby increasing tension on the second cable, and bending the second cable 116 around the second cable guide 118. Thus, the second cable 116 increases the force against the second set of cable guides, and therefore the collar 110 coupled to the thrust bearing 108 in a direction parallel to the first axis opposite motion of the structure 104, causing the seismic damping subsystem 102 to restore the structure 104 to the center position and realign over the pier 124.

In one implementation, the set of cable anchors 120—including the first cable anchor and the second cable anchor—are configured to anchor the cables to the base or foundation of the structure 104. More specifically, the first cable 112 and the second cable, and respective spring assemblies, are secured to the base of the structure 104 at a constant target tension force. In this example, during a seismic event, as the cables deflect from an initial position relative to the thrust bearing 108, due to lateral movement caused by vibration, the cables stiffen causing the spring assemblies to actuate. Therefore, during a seismic event, the seismic damping subsystem 102 can cause the spring assemblies to react laterally and reduce lateral (e.g., horizontal) forces—shown in FIGS. 7B and 7C.

In one implementation, the first spring assembly 126 includes a first spring configured to: in response to a first displacement of the structure 104 in a first horizontal direction along the second horizontal axis 160, apply a first restoring force to the first cable 112 in a second horizontal direction opposite the first horizontal direction along the second horizontal axis 160. In one example, the first restoring force is proportional to a first compliance in the second horizontal direction defining a first maximum displacement of the structure 104 along the second horizontal axis 160 at which the thrust bearing 108 remains in contact with the thrust plate 106.

Further, the second spring assembly 128 can include a second spring configured to: in response to a first displacement of the structure 104 in a third horizontal direction on the first horizontal axis 150, apply a second restoring force to the second cable 116 in the fourth horizontal direction opposite the third horizontal direction on the first horizontal axis 150. In one example, the second restoring force is proportional to a second compliance in the first horizontal direction defining a second maximum displacement of the structure 104 along the first horizontal axis 150.

Figure 7A:
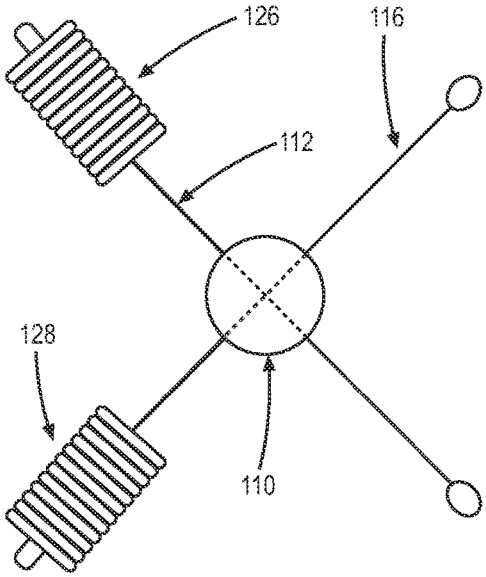
FIG. 7A is a top view schematic illustration of the foundation system.
Figure 7B:
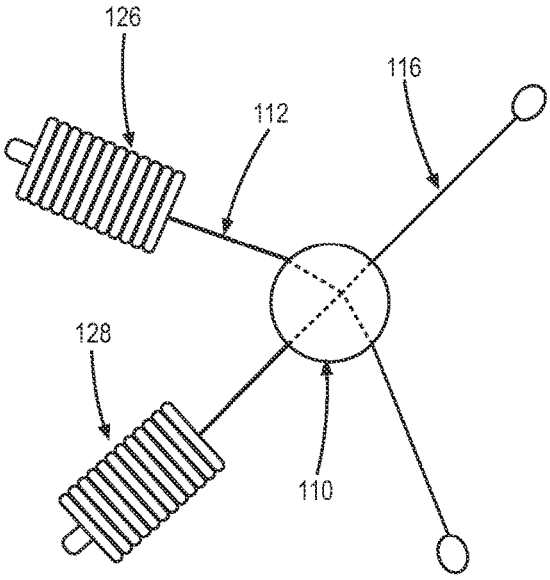
FIG. 7B is a top view schematic illustration of the foundation system.
Figure 7C:
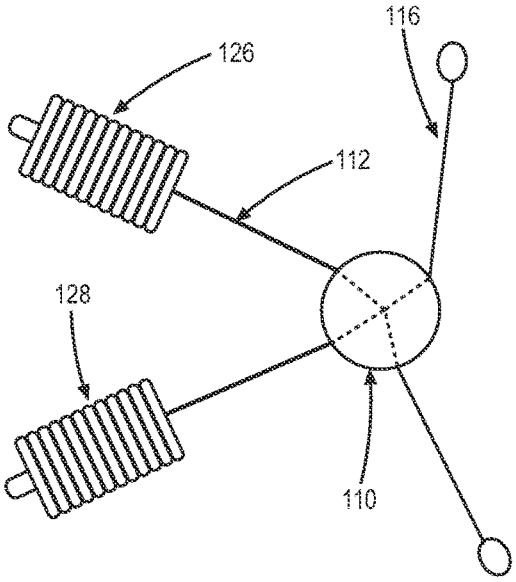
FIG. 7C is a top view schematic illustration of the foundation system.

In one implementation—shown in FIG. 7C—in response to a displacement of the structure 104 along a third horizontal axis non-parallel to the first horizontal axis 150 and/or the second horizontal axis 160 during a seismic event: the first cable 112 slides through the first cable guide 114; the second cable 116 slides through the second cable guide 118; the first collar 110 imparts a first bending force on the first cable 112 parallel to the second horizontal axis 160 and imparts a second bending force on the second cable 116 parallel to the first horizontal axis 150; the first cable 112 deflects from the first horizontal axis 150, proportional to the first bending force, to displace the first spring assembly 126; the first spring assembly 126 tensions the first cable 112 along the first horizontal axis 150; the first cable 112 imparts a first restoring force to the collar 110 parallel to the second horizonal axis; the second cable 116 deflects from the second horizontal axis 160, proportional to the second bending force, to displace the second spring assembly 128; the second spring assembly 128 tensions the second cable 116 along the second horizontal axis 160; and the second cable 116 imparts a second restoring force to the collar 110 parallel to the first horizonal axis.

For example, wherein the third horizontal axis is arranged 30° offset from the first horizontal axis 150, the first spring assembly 126 tensions the first cable 112 to impart a first restoring force in the second horizontal axis 160 double a second restoring force imparted by the second cable 116 tensioned by the second spring assembly 128 in the first horizontal axis 150.

In one implementation,—shown in FIG. 8C—in response to a first vertical displacement of the structure 104 in a first vertical direction along a vertical axis orthogonal to the first horizontal axis 150 and the second horizontal axis 160 (e.g., a wind force that lifts the structure 104 and therefore the thrust plate 106 off of the thrust bearing 108): the first cable guide 114 shifts in the first vertical direction; the first cable guide 114 deflects the first cable 112 a first distance away from the first horizontal axis 150; a spring of the first spring assembly 126 increases a first tensile force applied to the first cable 112 proportional to the first distance deflected by of the first cable; and the cable imparts a downward vertical force including a vertical component on the cable guide to pull the thrust plate 106 toward the thrust bearing 108.

In one implementation shown in FIG. 8B, the first end and the second end of the first cable 112 are arranged on a first horizontal plane defined by the first horizontal axis 150 and the second horizontal axis 160 and the first cable guide 114 is arranged offset from the first horizontal plane by a first offset distance. Due to the offset of the first cable 112 from the first horizontal plane, a first spring of the first spring assembly 126 applies a tension force to the first cable 112 and, in response the first cable: deflects out of the first horizontal plane by the first offset distance to pass through the cable guide; and imparts a vertical preload force including a vertical component of the tension force proportional to the first offset distance on the guide.

In one implementation, the first end and the second end of the first cable 112 are arranged on a first horizontal plane defined by the first horizontal axis 150 and the second horizontal axis 160. The first cable guide 114 is arranged offset above the first horizontal plane by a nominal offset distance during contact between the thrust plate 106 and the thrust bearing 108. In response to a wind force on the structure 104 that lifts the thrust plate 106 off of the thrust bearing 108: the first cable guide 114 shifts to a second offset distance from the horizontal plane by a second offset distance greater than the nominal offset distance; the first cable guide 114 deflects the first cable 112 away from the first horizontal plane; a first spring of the first spring assembly 126 increases a tensile force applied to the first cable 112 proportional to the second offset distance; and the first cable 112 imparts a downward vertical force including a vertical component of the tensile force on the first cable guide 114 to restore contact between the thrust plate and the thrust bearing 108.

5.6 Tuning

In one implementation, the first cable 112 and the second cable, can be tensioned to a target tension (e.g., "tuned") during manufacturing of the seismic damping subsystem 102. In particular, the tension of the cables while the structure 104 occupies the center position is tunable based on forces predicted to act on the structure 104. For example, the cables are tuned based on a seismic profile of the geographic region of the structure 104. In this example, a structure 104 in a geographic region with strong seismic activity in the east-west direction can include higher spring constant spring assemblies aligned in the east-west direction than in the north-south direction. In another example, a foundation system 100 of a structure 104 in a highly seismically active region can include shorter cables than a foundation system 100 of a structure 104 in a region with little seismic activity. Therefore, each spring assembly is characterized by a spring constant based on the seismic profile of the location of the structure 104.

In one implementation, a cable is tuned by installing the spring assembly in a pre-compressed or pre-extended configuration. For example, installing the spring assembly with a spring partially-extended at the center position imparts a preload force on the cable, thereby increasing the tension of the cable.

In one variation, the first spring constant of a first spring assembly 126 of a structure 104 in a first geographic region characterized by a high amount of seismic activity is greater than the first spring constant of a structure 104 in a second geographic characterized by a low amount of seismic activity.

In this example, the first cable 112 and the second cable can be pretensioned to the target tension force based on structure 104 specifications and a target pier foundation arrangement. Therefore, by altering characteristics of the seismic damping subsystem 102—such as cable target tension, spring assembly orientation, cable length, cable thickness, cable angle, etc.—the seismic damping subsystem 102 can be implemented for different structure types (e.g., single-story, multi-story, residential, commercial, industrial) in different geographical areas exhibiting different ground conditions. More specifically, the geometry and characteristics of the seismic damping subsystem 102 can be altered and calibrated based on wind loads across geographical zones that are prone to varying vibration levels (e.g., earthquakes).

Figure 4:
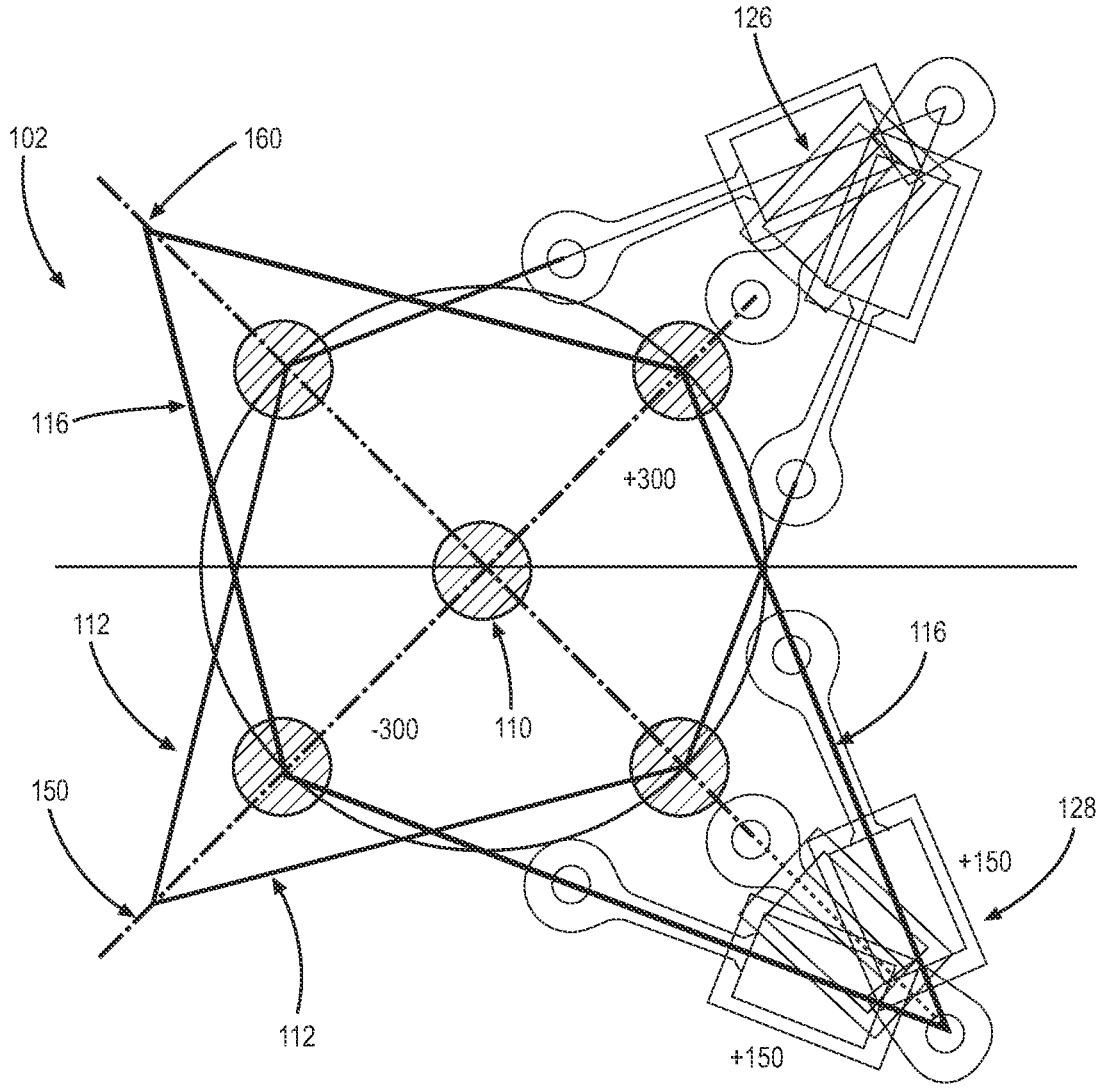
FIG. 4 is a top view schematic illustration of the foundation system.

In one variation, the first spring assembly 126 and the second spring assembly 128 can be tuned to actuate based on an actuation ratio for the set of spring assemblies of the seismic damping subsystem 102. For example, as shown in FIG. 4, the first spring assembly 126 can be tuned to actuate in response to the thrust bearing 108, and therefore a portion of the first cable 112 in the cylindrical base of the collar 110, thereby deflecting a first threshold distance (e.g., +/−300 mm) relative to the thrust plate 106 and perpendicular to the first cable. Similarly, as shown in FIG. 4, the first spring assembly 126 can be tuned to actuate in response to the first cable, at a connection point to the first spring assembly 126, deflecting a second threshold distance (e.g., +/−mm) relative to an initial position. In this example, the actuation ratio is 2:1. Thus, by adjusting target tensions on the cables, and therefore the spring assembly actuation ratio, the seismic damping subsystem 102 can respond differently to varying lateral forces.

The seismic damping subsystem 102 can be pretensioned during manufacturing for the seismic profile of the location of the structure 104. The tension of the cables can be further tuned during installation, such as to balance uneven forces on each pier 124 caused by imprecise installation of components or settling of the piers within the ground. Further, the "tuning" of the seismic damping subsystem 102 is changeable, such as during maintenance of the foundation system 100. For example, an operator can re-tune and maintain the seismic damping subsystem 102 in the case of an earthquake, nearby construction, changes to the structure 104, or settling.

Further, the seismic damping subsystem 102 can be configured to apply a downward preload to the structure 104 to retain and/or restore the thrust plate 106 of the bottom surface of the structure 104 in contact with the thrust bearing 108 coupled to the collar 110 of the pier 124 in response to vertical heave and or lift forces (e.g., wind forces). As shown in FIG. 8A, in one implementation, at the center position, the cable: aligns with a centerline defined by the spring assembly and the cable anchor 120; and runs through a cable guide along this centerline. As such, at the center position, the cable occupies a linear configuration on the horizontal plane defined by the first horizontal axis 150 and the second horizontal axis 160. Because the cable is retained in a linear configuration, the cable does not exert a force on the collar 110. However, as shown in FIG. 8B, in one implementation, the cable guide of the collar 110 is arranged offset above the centerline of the spring assembly and the cable anchor 120. Therefore, the cable is deflected (e.g., bent) away from the centerline by the cable guide of the collar 110. The deflection of the cable increases the effective length of the cable, thereby actuating the spring assembly and applying a downward preload force on the collar 110. The downward preload force pulls the thrust plate 106 down against the thrust bearing 108, thereby resisting lift forces on the structure 104. A seismic damping subsystem 102 can be tuned with a downward preload force, such as for structures in geographic locations with high winds or other heave and lift forces.

6. Foundation System Arrangement and Installation

In one implementation, the pier foundation system 100 is installable as a series of pre-assembled systems. The pre-assembled systems enabled fast and simple installation of the system.

Further, the pier foundation system 100 can include sets multi-use components, such as springs, cables, and dampers. These components match across multiple piers and can therefore be interchanged and/or installed without matching a specific component to a specific pier 124.

Due to the pre-assembled systems and multi-use components, the pier foundation system 100 does not require specialists for installation, and the foundation system 100 for a residential structure 104 is assemblable in a period of days (rather than a period of weeks or months for a traditional concrete foundation).

In one implementation, the pier foundation system 100 can be fabricated by casting the pier 124, and the set of helical extrusions as one component and then securing the vertical stabilizer 134 and an assembled seismic damping subsystem 102 to the pier 124. The pier foundation system 100 can then be driven into the ground via machinery (e.g., a loader, an excavator, etc.). More specifically, the pier 124 can be driven to a depth below the ground surface based on a terrestrial frost line depth corresponding to a particular geographical area. Thus, once the pier 124 is secured in the ground at the target depth, a portion of the pier 124 is exposed above the ground.

In one implementation, the vertical stabilizer 134 can be cast as a separate component and mounted on the shaft of the pier 124 during assembly of the pier foundation system 100. More specifically, the collar 110 of the vertical stabilizer 134 can be secured over the shaft of the pier 124 and pressed into the ground until the end plate aligns with the ground surface. Thus, the vertical stabilizer 134 can further reinforce the pier 124, and therefore the pier foundation system 100, while the structure 104 is subject to vertical (e.g., downward) forces caused by high winds, hurricanes, etc.

In one implementation, once the pier foundation system 100 is installed, the base layer (e.g., flooring) can be installed over the thrust plate 106 of the seismic damping subsystem 102 for construction of the structure 104 on top of the base.

As shown in FIG. 7A, a set of piers including a set of ground stability subsystems can be arranged to define the seismic pier foundation system 100. The set of piers can be arranged relative to the base of the structure 104 based on factors—such as a frost line depth, a structure mass, a structure geometry, a seismic profile, and/or a geographical location, etc. Thus, by installing piers in combination with the ground stability subsystem 130 for foundations, the pier foundation system 100 described herein can not only anchor structures (e.g., residential homes) to the ground and provide vertical support, but also attenuate vibrations caused by seismic events.

In one example implementation shown in FIG. 7A, the structure 104 defines a rectangular floorplan. In this example implementation, the pier foundation system 100 can be installed at each corner position of the base of the structure 104. In this variation, a ground stability subsystem 130 can be installed at a midpoint of the base of the structure 104 proximal the long edges of the rectangular structure 104 between a pair of piers.

In one implementation, when a structure 104 exceeds a threshold mass and/or is located in a geographical location prone to vibration (e.g., due to earthquakes) or exposure to high winds, the pier foundation system 100 can be installed in an alternate arrangement to increase stability and structural robustness. For example, a pier foundation system 100 can be installed at each corner position of the structure 104 at a distance from the corner edges. In this variation, a set of ground stability subsystems can be installed to traverse along each side of the structure 104 at a distance from the edges of the base. Additionally or alternatively, a set of ground stability subsystems can be positioned in a grid pattern across the base such that each ground stability subsystem 130 is spaced at set distance from an adjacent ground stability subsystem 130. Thus, the seismic pier foundation system 100 can be adjusted based on target structure 104 specifications as well as ground conditions in a particular geographical area.

In one implementation, once the pier foundation system 100 is arranged and each of the set of piers and the set of ground stability subsystems is installed, the base layer (e.g., flooring, bottom surface of the structure) can be installed on the thrust bearings of the pier foundation system 100.

7. Parapet Drain System

The pier foundation system 100 locates the structure above ground, thereby defining a crawl space between the ground and the structure. In one variation, pier foundation system 100 is paired with a parapet drain system 200 (e.g., a French drain system). The parapet drain system 200 is configured to: enclose the crawl space along the perimeter of the structure; and direct water away from the crawl space to prevent damage (e.g., mold, erosion) to the structure and the pier foundation system.

The parapet drain system 200 is arranged on the ground about a perimeter of the structure (e.g., structure 104). In one implementation, the parapet drain system 200 is arranged offset from the perimeter of the structure to enable the structure to translate under seismic loads without colliding with the parapet drain system 200. In one implementation, the parapet drain system 200 is configured to direct water away from the structure; and collect water away from the crawl space.

As shown in FIGS. 9, 10, 11, 12, 13, and 14, a parapet drain system 200 includes a set of parapet segments, each defining a stem section and a heel. The stem section of a parapet segment defines: a first end; a second end opposite the first end; a rectangular section extending laterally between the first and second ends; a bottom face configured to seat on a ground surface; a gutter section extending between the first end and the second end opposite the bottom face and configured to collect water flowing off of an exterior façade of a building arranged above the parapet segment; and an inner face configured to face a crawl space under the building and configured to locate under and proximal the exterior façade of the building. The heel of a parapet segment: extends longitudinally from the stem section proximal the bottom face and opposite the inner face; is configured for burial under earth sloped away from the building; and cooperates with the stem section to resist ground pressure from earth installed over the heel.

The set of parapet segments are configured to install around a base of a building to: form a parapet wall enclosing a crawl space under the building; form a continuous gutter section around a base of the building; and define a continuous finished edge around the base of the building with earth sloping away from the continuous finished edge.

In one variation, the stem section of a parapet segment includes a set of bores extending vertically through the heel and/or angled through the stem section and configured to receive stakes (e.g., rebar segments) driven into the earth below the parapet segment to retain the parapet segment against the earth.

In another variation, the stem section of a parapet segment includes: a boss extending from the first side of the stem section about the gutter section; and a relief inset from the second side of the stem section about the gutter section and configured to receive (and seal against) a boss extending from the first side of a second parapet segment installed adjacent the parapet segment.

Another variation of the parapet drain system 200 includes a distribution box: configured to install between two adjacent parapet segments; defining a collector configured to collect water from gutters of the two adjacent parapet segments; and defining an outlet coupled to the collector and configured to couple to a drainpipe.

Another variation of the parapet drain system 200 includes a set of gutter covers configured to install over and to prevent ingress of debris into gutter sections of the set of parapet segments.

In one variation, each parapet segment is rotomolded and configured to fill with water (e.g., for increased resistance to earth pressure). In another variation, each parapet segment is cast or molded expanded polymer (e.g., closed-cell extruded polystyrene foam).

8. Applications

Generally, the parapet drain system 200 includes: a set of parapet segments 202, each defining a base, a gutter section 214, and a heel 222; and a distribution box 226. The parapet segments 202 and the distribution box 226 cooperate to form a parapet wall—with integrated gutter, collector 228, and drain—around a base of a building and to enclose a crawlspace under the building. The parapet segments 202 are configured to install under a perimeter of the building (e.g., a prefabricated residential home) with the gutter sections 214 of these parapet segments 202 arranged directly below the outer walls of the building such that these gutter sections 214 catch water flowing down from the face of the building and divert this water away from the building.

Thus, the parapet drain system 200 can function to water prevent saturation of earth under and around the building, thereby reducing opportunity for water damage, earth movement and/or heaving (e.g., from freezing of wet earth), and mold growth under and around the underlying foundation of the structure.

Furthermore, each parapet segment 202 can include a cast closed-cell extruded polystyrene foam structure, which may be lightweight and resilient to prolonged ground contact. Thus, an installer may: set (e.g., dry set, set with adhesive, and/or stake) parapet segments 202 into position around a dirt or gravel area under the perimeter of an elevated building structure; locate a distribution box 226 between two adjacent parapet segments 202 in this assembly; connect a drain pipe between an outlet 230 of the distribution box 226 and a drain or sewer; backfill earth (e.g., dirt, gravel) over the heels 222 of these parapet segments 202, up to the edges of the gutter sections 214 and distribution box 226, and sloping away from the gutter sections 214 and the building; locate gutter covers 240 over the gutter sections 214; and then sod the backfilled earth to complete landscaping and water runoff control around the perimeter of the building.

In one implementation, each parapet segment 202 can be vertically reinforced to reduce lateral (e.g., horizontal) movement of the parapet drain system 200. In particular, a set of stakes (e.g., rebar) can be driven through the base and into the ground below at a set increment (e.g., every 0.25 m) to couple the parapet segment 202 to the ground. Thus, during a period of increased moisture (e.g., rain, melting snow) in the ground, when the ground is susceptible to movement (e.g., sliding), the stakes can reinforce the parapet segment 202 thereby reducing dislocation of the parapet segment 202 relative to the structure and leakage of flowing water in between sections of the parapet drain system 200.

The heel 222 can be configured to further stabilize the gutter of the parapet segment 202 while the parapet drain system 200 is installed in the ground. For example, following installation of the parapet drain system 200, a material—such as gravel, dirty, stone, concrete, soil, etc.—can be poured atop the heel 222 up to a top edge of the gutter. Thus, the weight (e.g., vertical force) of the material on the heel 222 can further anchor the parapet drain system 200, thereby reducing likelihood of sinkage and/or tipping of the parapet segment 202.

The parapet drain system 200 can further include a relief 220 and a boss 218 located at opposite ends of the parapet segment 202 configured to couple a first section of the parapet drain system 200 with a second (e.g., an adjacent) section of the parapet drain system 200. More specifically, the parapet drain system 200 can include a first relief 220 at a first end 206 of the parapet segment 202 extending from a top surface of the floor through a portion of the base; and a first boss 218 at a second end 208 of the parapet segment 202 protruding away from the parapet segment 202 and extending from the top surface of the floor through a portion of the base. Therefore, the relief 220 of the first section can engage with the boss 218 of the second section to mate the first and second section. In one implementation, an adhesive can be injected into a space defined by the relief 220 for connection of the first section to the second section. Thus, the connection between the first section, second section, and subsequent gutter sections 214 can define a continuous flow path for the water to divert away from the structure.

The parapet drain system 200 can further include a distribution box 226 configured to install between two adjacent parapet segments 202 including a collector 228 configured to collect water from gutters of the two adjacent parapet segments 202; and an outlet 230 coupled to the collector 228 and configured to couple to a drainpipe 232. For example, during moist conditions (e.g., heavy rain, melting snow), water levels can rise relative to the walls of the structure. Once the water levels exceed the top edge of the stem and flow into the gutter of the parapet segments 202, the water can flow through the interconnected parapet segments 202 and into the collector 228 of the distribution box 226. Thus, once the water reaches a distribution box 226, the water can flow through the outlet 230 into the drainpipes 232 and direct the water through the drainpipes 232. Therefore, the outlet 230 and drainpipe 232 can cooperate to drain water from the collector 228 and divert water away from the structure.

In one implementation, the parapet drain system 200 can be constructed of a hydrophobic material—such as polystyrene (e.g., closed-cell extruded polystyrene foam), etc. Therefore, the parapet drain system 200 can remain robust in the presence of moisture rather than breaking down. In one variation, the gutter section 214 and the distribution box 226 can be fabricated (e.g., cast) as one piece in set lengths (e.g., 1 m, 3 m, 8 m). Thus, during installation of the parapet drain system 200, the distribution box 226 can be disconnected from the gutter section 214 and positioned in an alternate location based on the arrangement and design of the parapet drain system 200. Additionally, or alternatively, the gutter sections 214 can be cut to a shorter length via a saw tool (e.g., a blade) to tailor the length of the gutter section 214 based on a structure geometry.

9. Stem Section

Generally, as shown in FIGS. 9, 10, 11, and 12, each parapet segment 202 of the parapet drain system 200 defines a stem section 204. More specifically, the stem section 204 of a parapet segment 202 includes: a first end 206; a second end 208 opposite the first end 206; a rectangular section 210 extending laterally between the first and second ends 208; and a bottom face 212 configured to seat on a ground surface. The stem section 204 further includes a gutter section 214 extending between the first end 206 and the second end 208 opposite the bottom face 212 and configured to collect water flowing off of an exterior façade of a building arranged (e.g., constructed) above the parapet segment 202. In one variation, a distance (e.g., 10 cm-15 cm) between the first end 206 and the second end 208 can define a gutter section 214 width. In one variation, the rectangular section 210 can have a depth of 7-10 cm defining a gutter section 214 height. Additionally, or alternatively, the rectangular section 210 can be curved (e.g., a "U" shape) between the first and second ends 208.

In one variation, the stem section 204 further includes an inner face 216 configured to face a crawl space positioned under the building and configured to locate under and proximal the exterior façade of the building.

In one implementation, the stem section 204 of a parapet segment 202 includes a boss 218 and a relief 220 to facilitate connection and installation of the parapet segments 202. More specifically, the stem section 204 includes a boss 218 extending from the first side of the stem section 204 about the gutter section 214; and a relief 220 inset from the second side of the stem section 204 about the gutter section 214 opposite the first side. The relief 220 is configured to receive (and seal against) a boss 218 extending from the first side of a second parapet segment 202 installed adjacent the parapet segment 202. Thus, the boss 218 can engage with a relief 220 on a second parapet segment 202 to generate a continuous flow path for the water flowing between the parapet segments 202 and the distribution boxes 226.

10. Heel

Generally, as described above and shown in FIGS. 9, 10, 11, and 12, the parapet drain system 200 further includes a heel 222 extending from a bottom portion of the stem section 204. For example, the heel 222 of a parapet segment 202 can extend longitudinally from the stem section 204 proximal the bottom face 212 and opposite the inner face 216. More specifically, the heel 222 is a flat panel extending from the stem section 204 and configured to traverse the length of the parapet segment 202. In one variation, the heel 222 is characterized by a height and length. For example, the heel 222 can be 5 cm in height and extend at a length of 12 cm. In one variation, the heel 222 can have an alternate height-to-length ratio. Therefore, the heel 222 can be buried under earth sloped away from the building and cooperate with the stem section 204 to resist ground pressure from earth installed over the heel 222.

Figure 11:
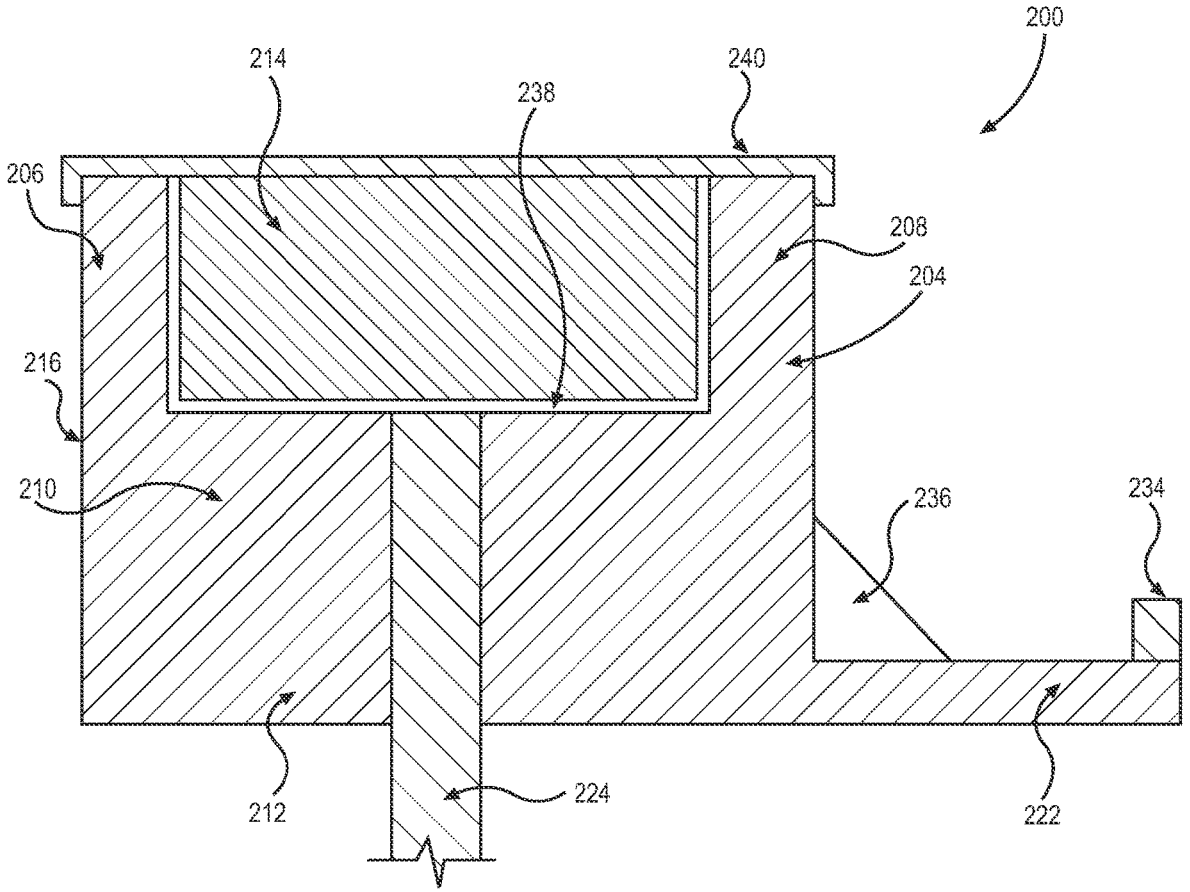
FIG. 11 is cross-sectional view of one variation of the parapet drain system.

As shown in FIG. 11, in one implementation, the heel 222 can include a gusset 236 positioned between the heel 222 and an exterior surface of the stem section 204 to reinforce the corner between the heel 222 and the stem section 204. In one variation, the gusset 236 can traverse the length of the parapet segment 202. Additionally or alternatively, the parapet segment 202 can include a set of gusset 236*s* at set lengths (e.g., 5 cm) positioned along the length of the parapet segment 202 (e.g., every 30 cm). Therefore, once earth is placed atop the heel 222 to hold the parapet drain system 200 in place, the gusset 236 can anchor the heel 222 to the stem section 204 and reduce chances of breakage and detachment of the heel 222 from the stem section 204.

As shown in FIG. 11, in one variation, the heel 222 can include a rib 234 located at an edge of the heel 222 traversing along the length of the heel 222. The rib 234 can extend vertically to define a rib 234 height (e.g., 3 cm) to further brace the heel 222 once earth is placed over the heel 222. For example, once the parapet segment 202 is installed and buried, the heel 222 can function to brace the parapet drain system 200 in place and reduce dislocation of the parapet segment 202 once installed.

11. Distribution Box

Generally, as described above and shown in FIG. 13, the parapet drain system 200 further includes a distribution box 226 configured to install between two adjacent parapet segments 202. In one implementation, the distribution box 226 can define a collector 228 configured to collect water from gutters of the two adjacent parapet segments 202. In one variation, the distribution box 226 can include a heel 222 coupled to a stem of a gutter section 214 to stabilize the distribution box 226. Thus, when coupled to a parapet segment 202, the distribution box 226 can cause water to flow continuously between the gutter section 214 of the parapet segment 202 and the gutter section 214 of the distribution box 226 to divert away from the building.

In one implementation, the distribution box 226 further includes an outlet 230 coupled to the collector 228 and configured to couple to a drainpipe 232. More specifically, the distribution box 226 can include an outlet 230 extending through a wall of the distribution box 226 to receive a drainpipe 232 (e.g., a polyvinyl chloride pipe, a plastic pipe). More specifically, the outlet 230 can be engaged with a drainpipe 232 extending away from the building in the direction of the heel 222. In this example, the drainpipe 232 can extend to a distance (e.g., 1 m, 3 m, 10 m) away from the building. Thus, as water flows through the gutter section 214 of an adjacent parapet segment 202 and into the distribution box 226, the distribution box 226 can direct water away from the structure via the drainpipe 232.

In one variation, the distribution box 226 is characterized by a length that is shorter than the gutter section 214 length—such as, 0.25 m, 0.5 m, 1 m, etc.

In one variation, the distribution box 226 can include a boss 218 positioned at a first end 206 and a relief 220 positioned at a second end 208 opposite the first end 206 to facilitate connection and installation of the distribution box 226. More specifically, the distribution box 226 includes a boss 218 extending from the first end 206 about the collector 228; and a relief 220 inset from the second end 208 about the collector 228 opposite the first end 206. The relief 220 is configured to receive (and seal against) a boss 218 extending from the first side of a parapet segment 202 or a second distribution box 226 installed adjacent the distribution box 226. Thus, the boss 218 can engage with a relief 220 on a second parapet segment 202 or a second distribution box 226 to generate a continuous flow path for the water flowing between the parapet segments 202 and the distribution boxes 226.

12. Fabrication

In one implementation, each parapet segment 202 can be cast, extruded, or molded expanded polymer (e.g., closed-cell extruded polystyrene foam). In another implementation, each parapet segment 202 can be molded (e.g., rotomolded, blow-molded) of rigid polymer defining a hollow cavity, a fill plug, and a drain plug. In this example, each parapet segment 202 is configured to fill with water (e.g., building runoff) via the fill plug to increase the weight the parapet section once the parapet section is installed around the base of the building (and before the heel 222 of the parapet section is covered with earth) and further anchor the parapet segment 202. Additionally, or alternatively, water can drain from the parapet segment 202 via the drain plug.

13. Installation

Generally, the parapet drain system 200 can be installed following construction of a structure (e.g., a residential housing unit) atop a foundation. In one implementation, a base (e.g., flooring) of the structure is placed atop a pier foundation system installed (e.g., driven) into the ground. More specifically, the pier foundation system can include a set of seismic piers and/or a set of helical piers driven into the ground that function to anchor and support the structure. During or following construction of the structure, a trench can be dug surrounding the structure to receive the parapet drain system 200.

In one implementation, the parapet drain system 200 can be installed around the perimeter of the structure. More specifically, the parapet drain system 200 can be installed along each side (e.g., wall) of the structure to divert water surrounding the structure. For example, the set of parapet segments 202 are configured to install around the base of a building to form a parapet wall enclosing a crawl space under the building. Thus, the set of parapet segments 202 can form a continuous gutter section 214 around a base of the building and define a continuous finished edge around the base of the building with earth sloping away from the continuous finished edge. In one variation, the parapet drain system 200 can be installed around a portion of the perimeter of the structure. For example, the parapet drain system 200 can be installed along a subset (e.g., three) of the total sides (e.g., four) of the structure.

13.1 Parapet Segments

In one implementation, the parapet drain system 200 can be constructed and sold in sections of a set length—such as, 1 m, 4 m, 7 m, etc. More specifically, during fabrication, the gutter section 214 and heel 222 can be cast as one component. Additionally, or alternatively, the gutter section 214 and heel 222 can be cast separately and coupled (e.g., glued) during manufacture or installation of the parapet drain system 200. In one variation, each parapet segment 202 is rotomolded and configured to fill with water (e.g., for increased resistance to earth pressure). In another variation, each parapet segment 202 is cast in molded expanded polymer (e.g., closed-cell extruded polystyrene foam). Thus, during installation of the parapet drain system 200, the parapet segments 202 can be cut to an installation length shorter than the fabrication length via a saw tool (e.g., a blade) in order to tailor the length of the parapet segments 202 to a structure geometry.

In one variation, the distribution box 226 can be constructed (e.g., cast) during fabrication of the parapet segments 202. More specifically, the distribution box 226 can be cast or fabricated by molded expanded polymer (e.g., closed-cell extruded polystyrene foam) in sections of a set length (e.g., 0.25 m, 0.5, 1., etc.) and coupled to an end of the parapet segment 202 during fabrication. Thus, the parapet segment 202 and the distribution box 226 can be sold for purchase as one system. For example, during installation of the parapet drain system 200, the distribution box 226 can be cut off from the parapet segment 202 via a saw tool for later installation in a particular location or be discarded.

In one variation, the distribution box 226 can be constructed as a separate component and sold individually. Thus, upon assembly of the parapet drain system 200, the distribution box 226 can be positioned adjacent to parapet segments 202 based on a structure geometry, construction constraints, and/or a target drainpipe 232 quantity.

13.2 Parapet Segment Position

Generally, the parapet drain system 200 can be positioned under the building and along the exterior façade of the building to collect water flowing off of the walls of the building. More specifically, the parapet section can be installed at a position in which the inner face 216 of the stem section 204 faces the foundation (e.g., a crawl space) of the building. Thus, water can flow off the exterior façade of the building: into the gutter section 214 of the parapet segment 202; into the collector 228 of the distribution box 226; through the outlet 230 of the distribution bow; and can be directed away from the building via the drainpipe 232. Therefore, the parapet segment 202 and the distribution box 226 of the parapet drain system 200 can cooperate to reduce water flow beneath the building into the space surrounding the foundation system.

13.3 Parapet Segment Anchoring

In one implementation, during or after construction of the structure on the foundation, a trench can be dug surrounding the structure to receive sections of the parapet drain system 200. More specifically, the parapet sections of the parapet drain system 200 can be installed in the trench surrounding the structure and secured in place via stakes. To reinforce the parapet drain system 200 in the void, gravel and/or earth can be poured surrounding the parapet segment 202 and distribution box 226 to backfill the void and stabilize the parapet drain system 200 in the void. Thus, backfilling the void surrounding the parapet segments 202 and distribution box 226 can reduce lateral (e.g., horizontal) movement of the parapet drain system 200 relative to the structure.

In one implementation, the parapet segment 202 includes a set of bores 224 extending vertically and/or at an angle through the stem section 204 configured to receive stakes (e.g., rebar segments) driven into the earth below the parapet segment 202 to retain the parapet segment 202 against the earth. More specifically, a stake can be driven vertically through the set of bores 224 of the stem section 204 at a set increment (e.g., every 0.25 m, 0.5 m) to couple the parapet segment 202 to the ground. In one variation, a stake can be driven at an angle (e.g., 30 degrees) through the set of bores 224 of the stem section 204 at a set increment. In one variation, the parapet segment 202 includes a set of bores 224 extending vertically through the heel 222 configured to receive stakes (e.g., rebar segments) driven into the earth below the parapet segment 202 to anchor the parapet segment 202 against the earth.

In one variation, a set of stakes (e.g., rebar segments) can be driven through the heel 222 of the parapet segment 202 into the earth below the parapet segment 202 to further anchor the parapet segment 202.

Figure 9:
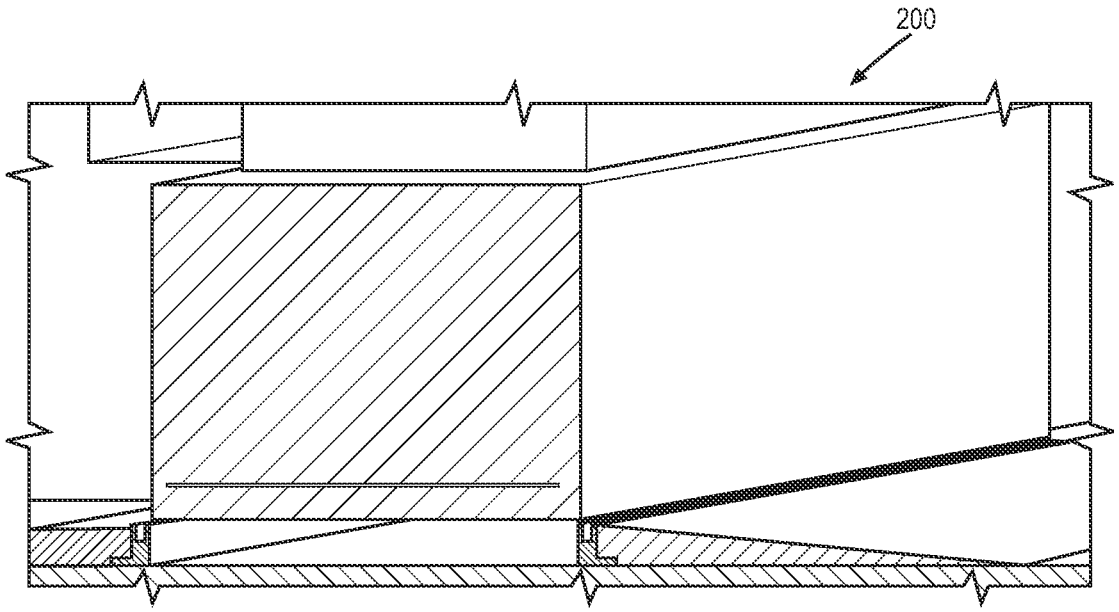
FIG. 9 is an isometric view of one variation of a parapet drain system.
Figure 10:
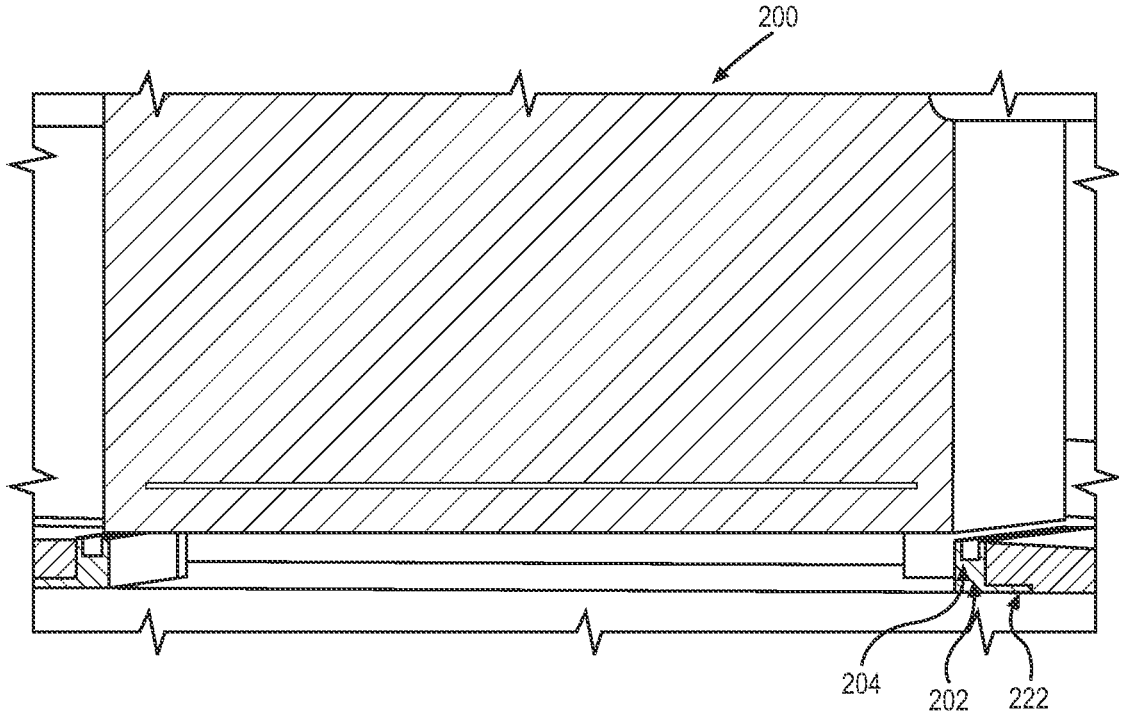
FIG. 10 is cross-sectional view of one variation of the parapet drain system.

As shown in FIG. 9, in one implementation, to further stabilize the parapet drain system 200, a layer of material—such as, dirt, soil, gravel, concrete, etc.—can be placed over the heel 222 to further stabilize the parapet segment 202. More specifically, the material can be poured over the heel 222 until the material reaches a top edge of the gutter section 214. In one variation, once the heel 222 is buried under the material, a layer of sod or turf can be placed over the material. Therefore, the weight (e.g., vertical force) of the material can further hold the parapet segment 202 and heel 222 in place by reducing horizontal (e.g., motion along the surface of the ground) and vertical (e.g., rising from the ground, tipping over) movement of the parapet drain system 200 relative to the structure. Additionally, or alternatively, the layer of material can be placed over the heel 222 at an angle to form a surface sloped away from the building.

13.4 System Assembly

Figure 12:
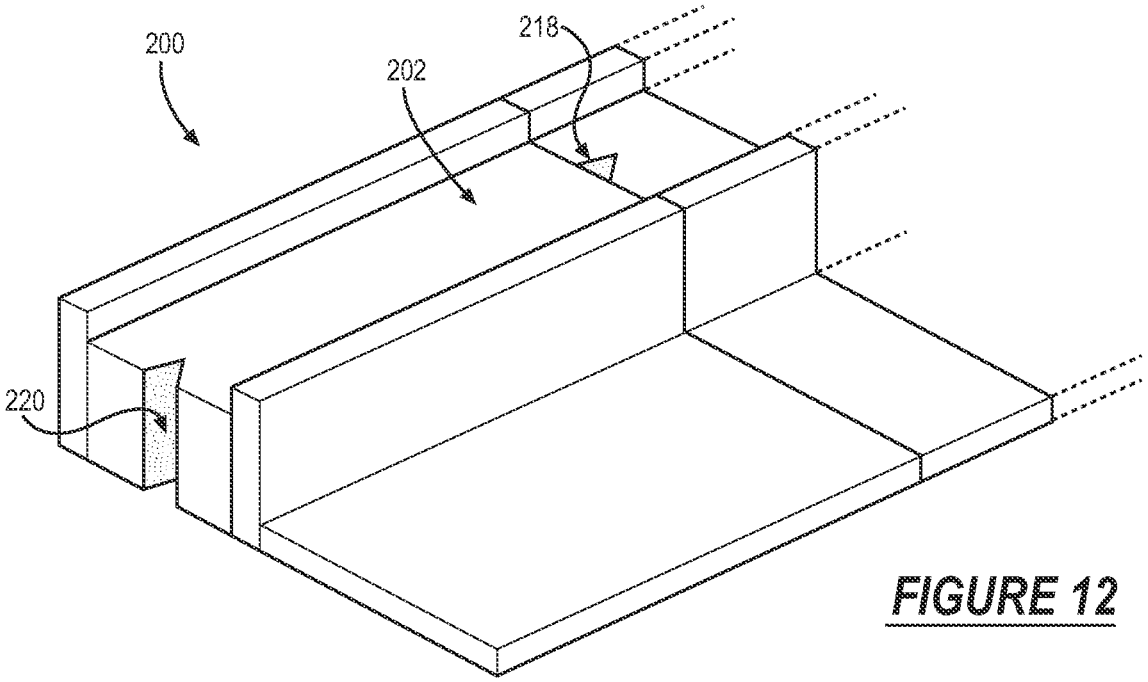
FIG. 12 is an isometric view of one variation of the parapet drain system.

As shown in FIG. 12, in one implementation, each section of the parapet drain system 200 can be coupled together via an adhesive (e.g., construction glue, caulk) at each end. More specifically, a set of parapet segments 202 can be secured together with a glue to construct a chain of parapet segments 202 that can traverse along the edge of a building. For example, a first parapet segment 202 can be positioned adjacent to a second parapet segment 202; a volume of adhesive can be applied to a relief 220 of the first segment; and a boss 218 of the second parapet segment 202 can be mated the relief 220 of the first parapet segment 202 to construct a chain of parapet segments 202. Thus, the chain of parapet segments 202 can facilitate continuous water flow between each parapet segment 202 and into a distribution box 226 thereby reducing water flow beneath the structure between parapet segments 202.

In one variation, a distribution box 226 can be coupled between a set (e.g., of parapet segments 202 to direct water away from the building. Additionally, or alternatively, a distribution box 226 can be coupled between each parapet section. For example, in areas prone to flooding and/or rainfall, a distribution box 226 can be coupled via the adhesive between each section of the parapet drain system 200 to divert water away from the structure at a higher rate than when a distribution box 226 is installed between a set of parapet segments 202.

In one implementation, an adhesive (e.g., caulk, construction glue) can be extruded into the relief 220 of the first section of the parapet drain system 200 to engage with the boss 218 of a second section of the parapet drain system 200. Thus, the first and second section can be pressed together to generate a continuous flow path for the water traveling through the trench of the first and second section.

13.5 Debris Collection

As shown in FIG. 11, in one implementation, the parapet drain system 200 includes a set of gutter covers 240 configured to install over the gutter section 214 and to prevent ingress of debris into gutter sections 214 of the set of parapet segments 202. More specifically, a grate or mesh can be installed over the top of the gutter section 214 to reduce debris collection an opening of the gutter section 214. For example, the gutter cover 240 can be constructed of a metal (e.g., steel) and placed over the top of the gutter section 214; couple to a top of the gutter section 214; and lay over the gutter section 214 opening. Therefore, the gutter cover 240 can function to reduce collection of debris—such as, leaves, insects, stones, animals, garbage, etc.—inside the gutter section 214. In one variation, the gutter cover 240 can be removable from the top of the gutter section 214 (e.g., during cleaning).

As shown in FIG. 11, in one implementation, the parapet drain system 200 includes a removable tray 238 positioned inside of the gutter section 214 and extending along the length of the gutter section 214. More specifically, the tray 238 can include a set of wings to wrap around and couple to the first and second ends 208 of the stem section 204 and a curved (e.g., "U" shaped) portion to fit into the rectangular section 210 of the gutter section 214 between the first and second ends 208. Thus, the tray 238 can function to collect debris—such as, sand, dirt, insects, dust, etc.—and can be removed from the gutter section 214 during cleaning to remove the debris and reduce likelihood of clogging of the parapet segment 202. In one variation, the tray 238 can be constructed of steel.

14. Sloped Gutter Section

Figure 14:
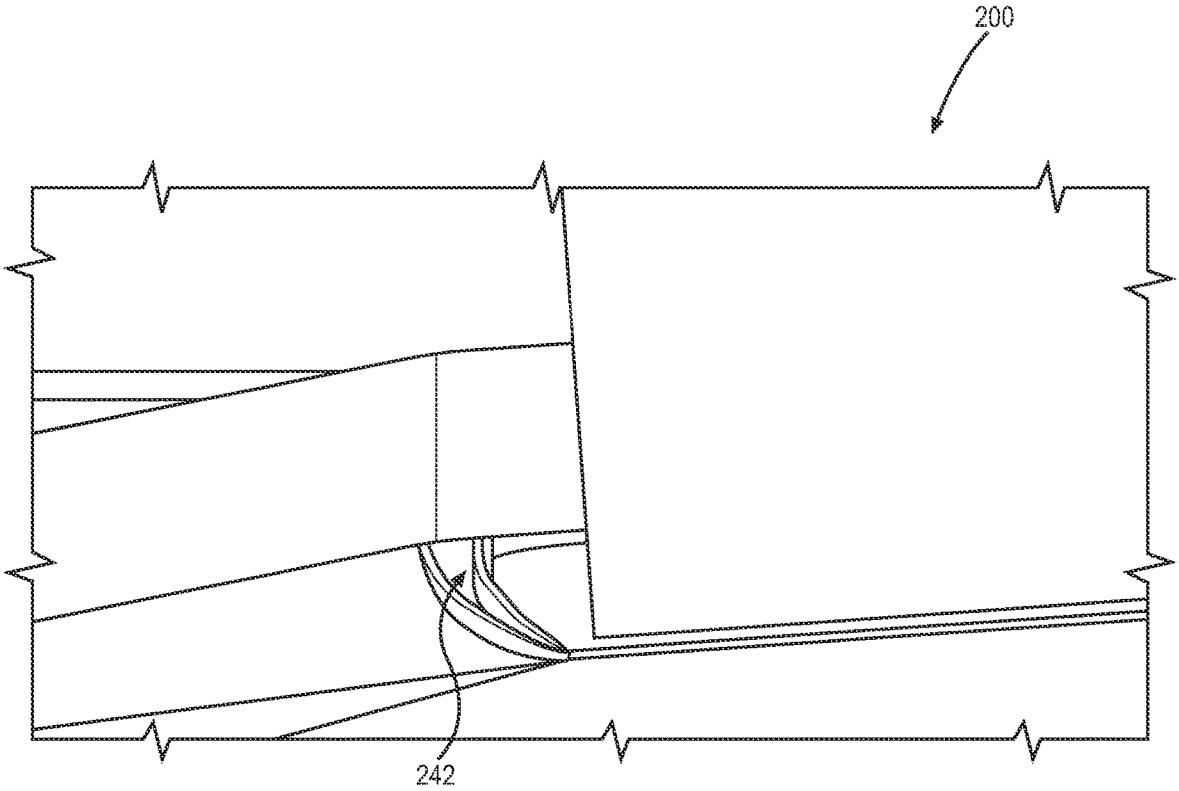
FIG. 14 is an isometric view of one variation of the parapet drain system.

As shown in FIG. 14, the parapet drain system 200 can further include a sloped gutter section 242 for directing water flow from a first level (e.g., a stair, a platform) to a second level (e.g., the ground), the second level located below the first level. In one implementation, a first end 206 (e.g., a top) of the sloped gutter section 242 can couple to a first surface located at the first level—such as, pavement, a doorstep, a driveway, a stair, a ramp, etc.—while a second end 208 (e.g., a bottom) opposite the first end 206 of the sloped gutter section 242 can couple to an end of a parapet segment 202 of the parapet drain system 200 installed at the second level. Thus, the sloped gutter section 242 can function to divert water flowing from a first level to a second (e.g., lower) level, and away from the structure.

Figure 13:
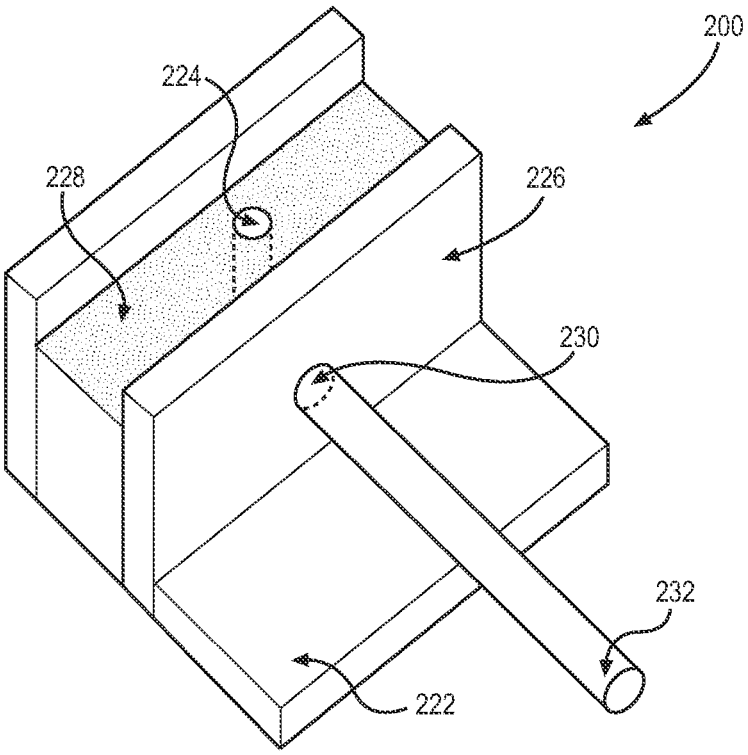
FIG. 13 is an isometric view of one variation of the parapet drain system.

As shown in FIG. 13, in one implementation, the sloped gutter section 242 can have a helical curve to couple the first surface when the parapet drain system 200 is positioned at a distance and a direction away from the first surface at the first level. In one variation, the sloped gutter section 242 can have a linear slope to couple the first surface to the gutter section 214 of the parapet drain system 200 positioned beneath the first surface. For example, when an edge of the first surface is aligned with an end of a parapet segment 202, a linear parapet segment 202 can direct water to a parapet segment 202 at the second level.

15. Conclusion

As a person skilled in the art will recognize from the previous detailed description and from the figures and claims, modifications and changes can be made to the embodiments of the invention without departing from the scope of this invention as defined in the following claims.

We claim:

1. A foundation system comprising:
- a first pier:
  - configured to support a bottom surface of a structure; and
  - comprising:
    - a distal end configured to install below a terrestrial frost line; and
    - a proximal end configured to extend above the terrestrial frost line;
- a first collar:
  - arranged on the proximal end of the first pier;
  - defining a first cable guide extending along a first horizontal axis; and
  - defining a second cable guide extending along a second horizontal axis orthogonal to the first horizontal axis;
- a thrust bearing arranged on the first collar opposite the first pier;
- a thrust plate arranged on the bottom surface of the structure;
  - configured to:
    - mate with the thrust bearing; and
    - transfer a vertical load of the structure onto the first pier via the thrust bearing;
- a first cable:
  - defining a first end coupled to the bottom surface of the structure;
  - extending along the first horizontal axis;
  - passing through the first cable guide; and
  - defining a second end opposite the first end;
- a second cable:
  - defining a third end coupled to the bottom surface of the structure;
  - extending along the second horizontal axis;
  - passing through the second cable guide; and
  - defining a fourth end opposite the third end;
- a first spring assembly:
  - coupled to the bottom surface of the structure and to the second end of the first cable;
  - configured to tension the first cable on the first horizontal axis to resist motion of the structure along the second horizontal axis;
  - configured to yield to tension in the first cable resulting from motion of the structure along the second horizontal axis from a center position; and
  - configured to tension the first cable along the first horizontal axis to return the structure to the center position; and
- a second spring assembly:
  - coupled to the bottom surface of the structure and to the fourth end of the second cable;
  - configured to tension the second cable along the second horizontal axis to resist motion of the structure along the first horizontal axis;
  - configured to yield to tension in the second cable resulting from motion of the structure along first horizontal axis from the center position; and
  - configured to tension the second cable along the first horizontal axis to return the structure to the center position.

2. The system of claim 1:
- wherein in response to a wind load that lifts the structure in a first vertical direction along a vertical axis orthogonal to the first horizontal axis and the second horizontal axis:
  - the first cable guide shifts in the first vertical direction;
  - the first cable guide deflects the first cable a first distance away from the first horizontal axis;
  - a spring of the first spring assembly increases a first tensile force applied to the first cable proportional to the first distance; and
  - the first cable imparts a downward vertical force comprising a vertical component on the first cable guide to pull the thrust plate toward the thrust bearing.

3. The system of claim 1:
- wherein the first end and the second end of the first cable are arranged on a first horizontal plane defined by the first horizontal axis and the second horizontal axis;
- wherein the first cable guide is arranged offset above the first horizontal plane by a first offset distance;

wherein a first spring of the first spring assembly applies a tension force to the first cable; and wherein the first cable, in response to the spring tensioning the first cable:

deflects out of the first horizontal plane by the first offset distance to pass through the first cable guide; and imparts a vertical preload force comprising a vertical component of the tension force proportional to the first offset distance on the guide.

4. The system of claim 1:

wherein the first end and the second end of the first cable are arranged on a first horizontal plane defined by the first horizontal axis and the second horizontal axis;

wherein the first cable guide is arranged offset above the first horizontal plane by a nominal offset distance during contact between the thrust plate and the thrust bearing; and wherein, in response to a wind force on the structure that lifts the thrust plate off of the thrust bearing:

the first cable guide shifts to a second offset distance from the horizontal plane distance greater than the nominal offset distance;

the first cable guide deflects the first cable away from the first horizontal plane;

a first spring of the first spring assembly increases a tensile force applied to the first cable proportional to the second offset distance; and the first cable imparts a downward vertical force comprising a vertical component of the tensile force on the first cable guide to restore contact between the thrust plate and the thrust bearing.

5. The system of claim 1:

wherein the first spring assembly comprises:

a first spring; and a first damper configured to damp oscillation of the structure along the second horizontal axis;

wherein the second spring assembly comprises:

a second spring; and a second damper configured to damp oscillation of the structure along the first horizontal axis; and wherein the first damper of the first spring assembly and the second damper of the second spring assembly cooperate to damp oscillation of the structure resulting from restoring forces exerted by the first spring assembly on the first cable and by the second spring assembly on the second cable responsive to horizontal displacement of the structure.

6. The system of claim 1:

wherein the first spring assembly comprises a first variable-pitch coil spring configured to apply an exponentially increasing restoring force on the first cable guide of the collar during increasing displacement of the structure from the center position.

7. The system of claim 1:

wherein the first cable guide comprises a first polymer insert configured to slide over the first cable;

wherein the second cable guide comprises a second polymer insert configured to slide over the second cable; and wherein, in response to a displacement of the structure parallel to the first horizontal axis during a seismic event:

the first cable slides through the first polymer insert of the first cable guide and occupies a linear arrangement;

the first collar:

imparts a first bending force on the first cable parallel to the second horizontal axis; and imparts a second bending force on the second cable parallel to the first horizontal axis, the second bending force greater than the first bending force;

the second cable deflects from the second horizontal axis, proportional to the second bending force, to displace the second spring assembly;

the second spring assembly tensions the second cable along the second horizontal axis; and the second cable imparts a restoring force to the collar parallel to the first horizontal axis.

8. The system of claim 1:

wherein, in response to a displacement of the structure along a third horizontal axis non-parallel to the first horizontal axis and the second horizontal axis during a seismic event:

the first cable slides through the first cable guide;

the second cable slides through the second cable guide;

the first collar:

imparts a first bending force on the first cable parallel to the second horizontal axis; and imparts a second bending force on the second cable parallel to the first horizontal axis;

the first cable deflects from the first horizontal axis, proportional to the first bending force, to displace the first spring assembly;

the first spring assembly tensions the first cable along the first horizontal axis;

the first cable imparts a first restoring force to the collar parallel to the second horizontal axis;

the second cable deflects from the second horizontal axis, proportional to the second bending force, to displace the second spring assembly;

the second spring assembly tensions the second cable along the second horizontal axis; and the second cable imparts a second restoring force to the collar parallel to the first horizontal axis.

9. The system of claim 1:

wherein the first cable guide defines a first hourglass surface comprising:

a first minor diameter at a center of the first cable guide and corresponding to a diameter for the first cable;

a first major diameter greater than the first minor diameter proximal a surface of the first collar; and a taper section:

extending between the first minor diameter and the first major diameter; and defining a taper angle corresponding to a maximum deflection angle of the first cable; and wherein the first cable comprises a braided steel cable configured to bend off the first horizontal axis and ride along the first minor diameter of the first hourglass surface.

10. The system of claim 1:

further comprising a leveling assembly arranged below the thrust bearing on the first pier comprising:

a vertical length adjustment element operable over a range of vertical positions configured to locate the thrust bearing in contact with the thrust plate; and a pivot configured to accommodate an offset angle between an axis of the first pier and a vector normal to the thrust plate.

11. The system of claim 1:
further comprising:
a second pier:
configured to support the bottom surface of the structure; and
comprising:
a distal end configured to install below the terrestrial frost line; and
a proximal end configured to extend above the terrestrial frost line;
a second thrust bearing arranged on the proximal end of the second pier;
a second thrust plate arranged on the bottom surface of the structure;
configured to:
mate with the second thrust bearing; and
transfer a vertical load of the structure onto the second pier via the second thrust bearing; and
a leveling assembly arranged below the second thrust bearing on the second pier comprising:
a vertical length adjustment element operable over a range of vertical positions configured to locate the second thrust bearing in contact with the second thrust plate.

12. The system of claim 11, further comprising:
a pivot configured to accommodate an offset angle between an axis of the second pier and a vector normal to the second thrust plate.

13. The system of claim 1:
wherein the thrust plate defines a downward-facing concave surface coupled to the bottom surface of the structure; and
wherein the thrust bearing defines a semi-spherical surface configured to:
mate with the downward-facing concave surface of the thrust plate;
translate laterally within the downward-facing concave surface of the thrust plate; and
lift the thrust plate on the first pier to increase tension on the first cable and the second cable in response to displacement of the structure along the first horizontal axis.

14. The system of claim 1:
wherein the thrust plate defines a first planar surface coupled to the bottom surface of the structure; and
wherein the thrust bearing defines a second planar surface configured to slide against the first planar surface of the thrust plate.

15. The system of claim 1:
wherein the first spring assembly comprises a first spring configured to:
apply a first restoring force to the first cable in a second horizontal direction opposite the first horizontal direction along the second horizontal axis in response to a first displacement of the structure in a first horizontal direction along the second horizontal axis, the first restoring force proportional to a maximum displacement of the structure from the center position at which the thrust bearing contacts the thrust plate.

16. The system of claim 1, further comprising:
a second pier:
configured to support the bottom surface of the structure; and
comprising:
a distal end configured to install below a terrestrial frost line; and
a proximal end configured to extend above the terrestrial frost line;
a second collar:
arranged on the proximal end of the second pier;
defining a third cable guide extending along a third horizontal axis; and
defining a fourth cable guide extending along a fourth horizontal axis orthogonal to the third horizontal axis;
a second thrust bearing arranged on the second collar opposite the second pier;
a second thrust plate arranged on the bottom surface of the structure;
configured to:
mate with the second thrust bearing;
slide horizontally against the second thrust bearing; and
transfer a second portion of the vertical load of the structure onto the second pier via the second thrust bearing;
a third cable:
defining a fifth end coupled to the bottom surface of the structure;
extending along the third horizontal axis;
passing through the third cable guide; and
defining a sixth end opposite the fifth end;
a fourth cable:
defining a seventh end coupled to the bottom surface of the structure;
extending along the fourth horizontal axis;
passing through the fourth cable guide; and
defining an eighth end opposite the seventh end;
a third spring assembly:
coupled to the bottom surface of the structure and to the sixth end of the third cable;
configured to tension the third cable along the third horizontal axis to resist motion of the structure along the fourth horizontal axis;
configured to yield to tension in the third cable resulting from motion of the structure along the fourth horizontal axis from the center position; and
configured to tension the third cable along the third horizontal axis to return the structure to the center position; and
a fourth spring assembly:
coupled to the bottom surface of the structure and to the eighth end of the fourth cable;
configured to tension the fourth cable along the fourth horizontal axis to resist motion of the structure along the third horizontal axis;
configured to yield to tension in the fourth cable resulting from motion of the structure along the third horizontal axis from the center position;
configured to tension the fourth cable along the fourth horizontal axis to return the structure to the center position; and
configured to cooperate with the first pier to:
form a foundation supporting the structure;
define the center position based on a balance of forces applied by the first spring, the second spring, the third spring, and the fourth spring within a horizontal plane containing the first horizontal axis, the second horizontal axis, the third horizontal axis, and the fourth horizontal axis.

17. The system of claim 1, further comprising:
a second pier:
configured to support the bottom surface of the structure; and
comprising:
a distal end configured to install below a terrestrial frost line; and
a proximal end configured to extend above the terrestrial frost line;
a thrust bearing arranged on the proximal end of the second pier;
a thrust plate arranged on the bottom surface of the structure;
configured to:
mate with the thrust bearing;
slide horizontally against the thrust bearing; and
transfer a vertical load of the structure onto the second pier via the thrust bearing; and
wherein the second pier is configured to cooperate with the first pier to form a foundation supporting the structure.

18. A system comprising:
a first pier:
configured to support a bottom surface of a structure; and
comprising:
a distal end configured to install below a terrestrial frost line; and
a proximal end configured to extend above the terrestrial frost line;
a collar:
arranged on the proximal end of the first pier;
defining a first cable guide extending along a first horizontal axis; and
defining a second cable guide extending along a second horizontal axis orthogonal to the first horizontal axis;
a thrust bearing arranged on the collar opposite the first pier;
a thrust plate arranged on the bottom surface of the structure;
configured to:
mate with the thrust bearing; and
transfer a vertical load of the structure onto the first pier via the thrust bearing;
a first cable:
defining a first end coupled to the bottom surface of the structure;
extending along the first horizontal axis;
passing through the first cable guide; and
defining a second end opposite the first end;
a second cable:
defining a third end coupled to the bottom surface of the structure;
extending along the second horizontal axis;
passing through the second cable guide; and
defining a fourth end opposite the third end;
a first spring assembly:
coupled to the bottom surface of the structure and to the second end of the first cable; and
configured to tension the first cable along the first horizontal axis to resist motion of the structure along the second horizontal axis; and
a second spring assembly:
coupled to the bottom surface of the structure and to the fourth end of the second cable; and
configured to tension the second cable along the second horizontal axis to resist motion of the structure along the first horizontal axis.

19. The system of claim 18:
wherein the first spring assembly is further configured to:
yield to tension in the first cable resulting from motion of the structure along the second horizontal axis from a center position; and
tension the first cable along the first horizontal axis to return the structure to the center position; and
wherein the second spring assembly is further configured to:
yield to tension in the second cable resulting from motion of the structure along the first horizontal axis from the center position; and
tension the second cable along the second horizontal axis to return the structure to the center position.

20. A system comprising:
a first pier configured to support a bottom surface of a structure comprising:
a distal end:
installed below a terrestrial frost line; and
a proximal end:
extending above the terrestrial frost line;
a first cable:
defining a first end coupled to the bottom surface of the structure;
extending along a first horizontal axis;
passing through a first cable guide; and
defining a second end opposite the first end;
second cable:
defining a third end coupled to the bottom surface of the structure;
extending along a second horizontal axis;
passing through a second cable guide; and
defining a fourth end opposite the third end;
first spring assembly:
coupled to the structure and to the second end of the first cable;
configured to tension the first cable along the first horizontal axis to resist motion of the structure along the second horizontal axis; and
characterized by a first spring constant based on a seismic profile of a location of the structure; and
second spring assembly:
coupled to the structure and to the fourth end of the second cable;
configured to tension the second cable along the second horizontal axis to resist motion of the structure along the first horizontal axis; and
characterized by a second spring constant based on the seismic profile of the location of the structure.

* * * * *